US006311026B1

(12) United States Patent
Higeta et al.

(10) Patent No.: US 6,311,026 B1
(45) Date of Patent: Oct. 30, 2001

(54) PROCESS CARTRIDGE AND IMAGE FORMING APPARATUS INCLUDING MEANS FOR DETECTING MOUNTING OF THE PROCESS CARTRIDGE TO MAIN BODY OF IMAGE FORMING APPARATUS, AND PROCESS CARTRIDGE AND DEVELOPER CARTRIDGE INCLUDING POSITIONING PORTION

(75) Inventors: Akira Higeta, Funabashi; Hideshi Kawaguchi, Toride, both of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/439,087

(22) Filed: Nov. 12, 1999

(30) Foreign Application Priority Data

Nov. 13, 1998 (JP) ..... 10-341035
Dec. 25, 1998 (JP) ..... 10-369627

(51) Int. Cl.[7] ..... G03G 15/00; G03G 21/16
(52) U.S. Cl. ..... 399/13; 399/111
(58) Field of Search ..... 399/13, 111, 113, 399/116

(56) References Cited

U.S. PATENT DOCUMENTS

| | | | |
|---|---|---|---|
| 5,331,373 | 7/1994 | Nomura et al. | 355/200 |
| 5,452,056 | 9/1995 | Nomura et al. | 355/200 |
| 5,485,249 | 1/1996 | Higeta et al. | 355/210 |
| 5,585,889 | 12/1996 | Shishido et al. | 355/200 |
| 5,642,187 | 6/1997 | Nomura et al. | 399/111 |
| 5,650,841 | 7/1997 | Matsuda et al. | 399/111 |
| 5,678,139 | 10/1997 | Nomura et al. | 399/114 |
| 5,697,022 | 12/1997 | Matsuda et al. | 399/102 |
| 5,740,499 | 4/1998 | Higeta et al. | 399/105 |
| 5,809,374 | 9/1998 | Tsuda et al. | 399/111 |
| 5,825,472 | 10/1998 | Araki et al. | 355/200 |
| 5,907,751 | 5/1999 | Kawaguchi et al. | 399/117 |
| 5,909,603 * | 6/1999 | Suzuki et al. | 399/13 |
| 5,953,562 | 9/1999 | Kawaguchi et al. | 399/117 |
| 6,029,019 * | 2/2000 | Kawai | 399/13 |

FOREIGN PATENT DOCUMENTS 10-240103 9/1998 (JP) .

* cited by examiner

*Primary Examiner*—Fred L. Braun
(74) *Attorney, Agent, or Firm*—Fitzpatrick, Cella, Harper & Scinto

(57) ABSTRACT

A process cartridge detachably mountable to a main body of an image forming apparatus includes an electrophotographic photosensitive drum, a process device acting on the electrophotographic photosensitive drum, and a cartridge side positioning portion adapted to contact and be positioned by the positioning portion of the main body of the image forming apparatus when the process cartridge is mounted to the main body of the image forming apparatus. The cartridge has on or near the cartridge side positioning portion a detecting action portion for operating a cartridge detecting device for detecting the mounting of the process cartridge provided in the main body of the image forming apparatus when the process cartridge has been mounted at a mounting position in the main body of the image forming apparatus.

24 Claims, 37 Drawing Sheets

PRIMARY AC VOLTAGE

PRIMARY CHARGING VOLTAGE

OUTPUT VOLTAGE OF HALF-WAVE RECTIFYING CIRCUIT

OUTPUT OF HIGH-VOLTAGE GENERATING CIRCUIT 214

OUTPUT OF DIFFERENTIAL CIRCUIT 215

OUTPUT OF PEAK HOLD CIRCUIT 216

PROCESS CARTRIDGE AND IMAGE FORMING APPARATUS INCLUDING MEANS FOR DETECTING MOUNTING OF THE PROCESS CARTRIDGE TO MAIN BODY OF IMAGE FORMING APPARATUS, AND PROCESS CARTRIDGE AND DEVELOPER CARTRIDGE INCLUDING POSITIONING PORTION

BACKGROUND OF THE INVENTION

1. Field of the Invention

This invention relates to a process cartridge, a developer cartridge and an electrophotographic image forming apparatus to which the process cartridge or/and the developer cartridge are detachably mountable.

Here, the electrophotographic image forming apparatus includes, for example, an electrophotographic copying machine, an electrophotographic printer (such as an LED printer or a laser beam printer), an electrophotographic facsimile apparatus and an electrophotographic word processor.

Also, as the process cartridge, charging means, developing means or cleaning means and an electrophotographic photosensitive member are integrally made into a cartridge detachably mountable to the main body of the image forming apparatus. Or at least one of charging means, developing means and cleaning means and an electrophotographic photosensitive member are integrally made into a cartridge detachably mountable to the main body of the image forming apparatus. Further, at least developing means and an electrophotographic photosensitive member are integrally made into a cartridge detachably mountable to the main body of the image forming apparatus.

2. Related Background Art

An image forming apparatus using the electrophotographic image forming process has heretofore adopted a process-cartridge system in which an electrophotographic photosensitive member and process means acting on the electrophotographic photosensitive member are integrally made into a cartridge detachably mountable to the main body of the image forming apparatus. According to this process-cartridge system, the maintenance of the apparatus can be done by a user himself without resorting to a serviceman and therefore, operability can be improved markedly. So, this process cartridge system is widely used in image forming apparatuses.

As shown in FIG. 39 of the accompanying drawings, a process cartridge B is provided with large-diametered portions 21*a* as projected portions coaxially with the center axis of a photosensitive drum and outside the photosensitive drum, and the main body 17 of an image forming apparatus is provided with a guide portion 32 for guiding the projected portions 21*a* to a final set position. The process cartridge B is adapted to be manually pushed into the final set position along, the guide portion 32 provided on the main body 17 of the image forming apparatus by an operator or a serviceman.

In order to prevent image formation from being effected with the mounting remaining incomplete at that time, a projection 50 or the like is provided on the process cartridge B, and a detecting portion 51 for the projection 50 or the like is provided on the main body 17 of the image forming apparatus. When the process cartridge B has come to the vicinity of the final set position in the main body 17 of the image forming, apparatus, the detecting portion of the main body 17 of the image forming apparatus detects the projection or the like of the process cartridge B. When the process cartridge B is not detected, the main body 17 of the image forming apparatus judges that the process cartridge is absent, and does not carry out the image forming step. Also, the message that the process cartridge is absent is sent to the main body 17 of the image forming apparatus or a computer, and the warning that the process cartridge is absent is output.

The above-described conventional art is effective to detect whether the process cartridge is mounted on the main body of the image forming apparatus.

SUMMARY OF THE INVENTION

The present invention is a further development of the aforedescribed conventional art.

It is an object of the present invention to provide a process cartridge, a developer cartridge and an electrophotographic image forming apparatus that can accurately detect that the process cartridge or/and the developer cartridge have been mounted on the main body of the apparatus.

It is another object of the present invention to provide a process cartridge, a developer cartridge and an electrophotographic image forming apparatus that are improved in the accuracy of detecting that the process cartridge or/and the developer cartridge have been mounted at a predetermined mounting position.

It is still another object of the present invention to provide a process cartridge, a developer cartridge and an electrophotographic image forming apparatus that have a low manufacturing cost of a detecting mechanism for detecting that the process cartridge or/and the developer cartridge have been mounted at a mounting position.

It is yet still another object of the present invention to provide a process cartridge having on or near a positioning portion of the process cartridge a detecting-action portion for operating cartridge detecting means for detecting the mounting of the process cartridge to the main body of an image forming apparatus when the process cartridge has been mounted at a mounting position in the main body of the image forming apparatus, and an electrophotographic image forming apparatus to which the process cartridge is detachably mountable.

It is a further object of the present invention to provide a process cartridge and a developer cartridge having a positioning portion of the cartridge, the positioning portion having an electrode to be connected to an electrode provided on a positioning portion of a mounting portion provided in the main body of an image forming apparatus, and for supplying an electric current from the main body of the image forming apparatus to process means or for grounding an electrophotographic photosensitive member, and an electrophotographic image forming apparatus to which the process cartridge or/and the developer cartridge are detachably mountable.

These and other objects, features and advantages of the present invention will become more apparent upon consideration of the following description of the preferred embodiments of the present invention taken in conjunction with the accompanying drawings.

DESCRIPTION OF THE PREFERRED EMBODIMENTS

Figure 1:
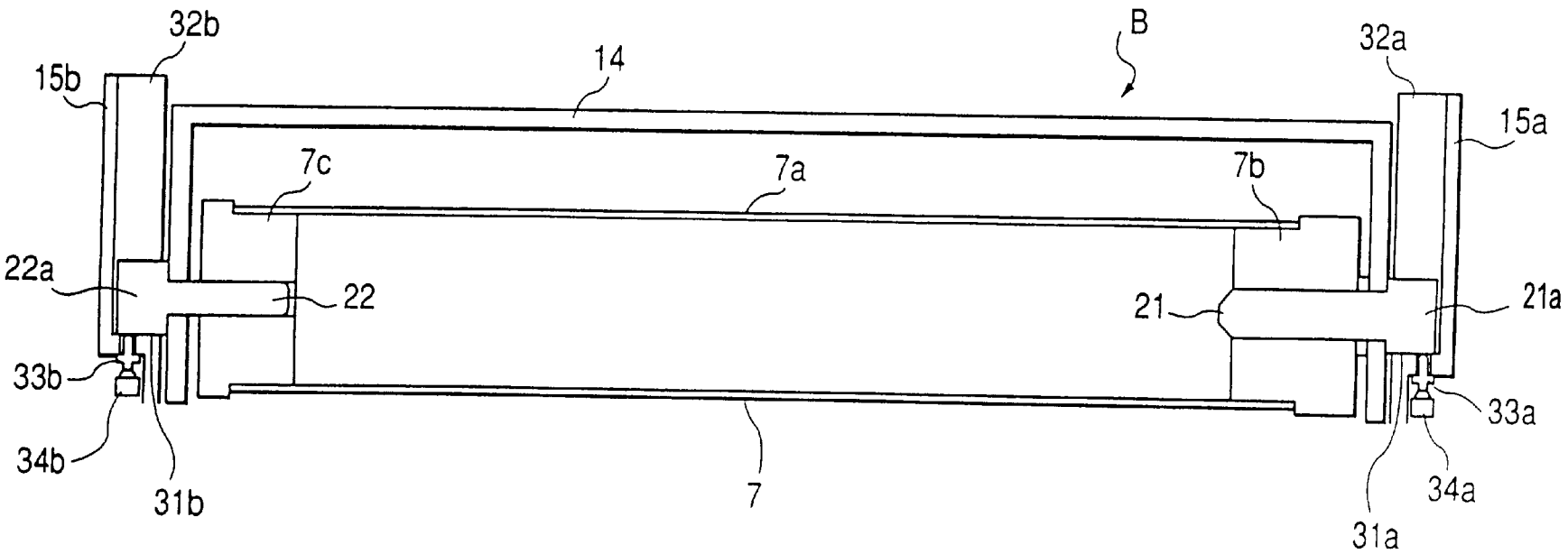
FIG. 1 is a schematic cross-sectional view showing the construction of the essential portions of Embodiment 1 of the present invention (after mounting).

Some embodiments of a process cartridge and an electrophotographic image forming apparatus (hereinafter referred to as the image forming apparatus) according to the present invention will hereinafter be specifically described with reference to the drawings. In the following description, the longitudinal direction refers to a horizontal direction orthogonal to a direction of insertion of the process cartridge into the main body of the image forming apparatus. A direction orthogonal to the longitudinal direction is referred to as the lateral direction.

(Embodiment 1)

Embodiment 1 will hereinafter be described with reference to FIGS. 1 to 6. FIG. 4 is an illustration of the construction of the image forming apparatus in a state in which the process cartridge has been mounted.

[General Construction]

The image forming apparatus A, as shown in FIG. 4, forms an image on a recording medium by the electrophotographic image forming process. It forms a toner image on a drum-shaped electrophotographic photosensitive member (hereinafter referred to as the photosensitive drum), which is an image bearing member. In synchronism with the formation of the toner image, a recording medium 2 set on a sheet feed tray 3*a* is conveyed by conveying means 3 comprising a pickup roller 3*b* and a sheet feeding roller 3*c*. Then, the toner image formed on the photosensitive drum 7 of a process cartridge B is transferred to the recording medium 2 by a voltage being applied to a transfer roller 4 as transfer means. Thereafter, the recording medium 2 to which the toner image has been transferred is guided by a guide plate 3*d* and is conveyed to fixing means 5. This fixing means 5 comprises a fixing rotary member 5*a* containing a heater therein, and a pressure roller 5*b* for pressing the recording medium 2 against the rotary member 5*a* and conveying it, and applies heat and pressure to the recording medium 2 to thereby fix the transferred toner image on the recording medium 2. This recording medium 2 is conveyed by pairs of discharge rollers 3*e* and 3*f* and is discharged to a discharge portion 6. The transfer roller 4 has its opposite ends rotatably supported by bearings movable by a radial guide, not shown, of the photosensitive drum 7. The bearings are urged toward the photosensitive drum 7 by a compression coil spring. The transfer roller 4 is in a position in which it is pushed in by the photosensitive drum 7 in a state in which the process-12 cartridge B is not mounted on the main body 17 of the apparatus.

[Process Cartridge]

On the other hand, in the process cartridge B, as shown in FIG. 4, the photosensitive drum 7 having a photosensitive layer as the image bearing member is rotated and the surface thereof is uniformly charged by the application of a voltage from a charging roller 8, which is charging means. Then, a laser beam conforming to image information is applied from an optical system 1 to the photosensitive drum 7 through an exposure opening portion 9 to thereby form an electrostatic latent image on the photosensitive drum 7, and the latent image is developed by developing means 10 by the use of a toner. That is, the charging roller 8 is provided in contact with the photosensitive drum 7, and effects charging on the photosensitive drum 7. Also, the developing means 10 supplies the toner to the developing area of the photosensitive drum 7 to thereby develop the latent image formed on the photosensitive drum 7.

This developing means 10 supplies the toner in a toner chamber 10*a* to a developing chamber 10*b*, and a developing roller 10*c* mounted in the developing chamber 10*b* is rotated and a toner layer to which triboelectrification charge has been imparted by a developing blade 10*d* is formed on the surface of the developing roller 10*c* containing a stationary magnet therein, and the toner is supplied to the developing area of the photosensitive drum 7. The toner is transferred to the photosensitive drum 7 in conformity with the aforementioned latent image to thereby form a toner image and visualize it.

A voltage of the polarity opposite to that of the toner image is applied to the transfer roller 4 to thereby transfer the toner image formed on the photosensitive drum 7 to the recording medium 2, whereafter any residual toner on the photosensitive drum 7 is removed by cleaning means 11. The cleaning means 11 scrapes off the toner residual on the photosensitive drum 7 by an elastic cleaning blade 11*a* and collects it into a waste toner reservoir 11*b*.

Such parts as the photosensitive drum 7 are contained in a cartridge frame comprised of a toner developing frame 12, a toner developing wall member 13 and a cleaning frame 14 coupled together and are made into a cartridge. That is, the toner developing frame 12 and the toner developing wall member 13 are welded together to thereby constitute the toner chamber 10*a* and the developing chamber 10*b*, and the developing roller 10*c* and the developing blade 10*d* are mounted in the developing chamber 10*b*. Also, the photosensitive drum 7, the charging roller 8 and members constituting the cleaning means 11 are mounted in the cleaning frame 14. The toner developing frame 12 and the cleaning frame 14 are pivotally and movably coupled together to thereby constitute the process cartridge B.

The process cartridge B is provided with the exposure opening portion 9 for applying a light, conforming to image information, to the photosensitive drum 7 and a transfer opening portion 14*n* for opposing the photosensitive drum 7 to the recording medium 2. There is mounted a shutter member 16 capable of opening and closing the transfer opening portion 14*n*. That is, the transfer opening portion 14*n* is for transferring the toner image formed on the photosensitive drum 7 to the recording medium 2.

The mounting and dismounting of the process cartridge B to and from the image forming apparatus A will now be described with reference to FIGS. 1 to 6. FIGS. 2, 3, 5 and 6 show the state before the process cartridge B is mounted on the main body 17 of the image forming apparatus, and FIGS. 1 and 4 show the state after the process cartridge B has been mounted on the main body 17 of the image forming apparatus.

Figure 2:
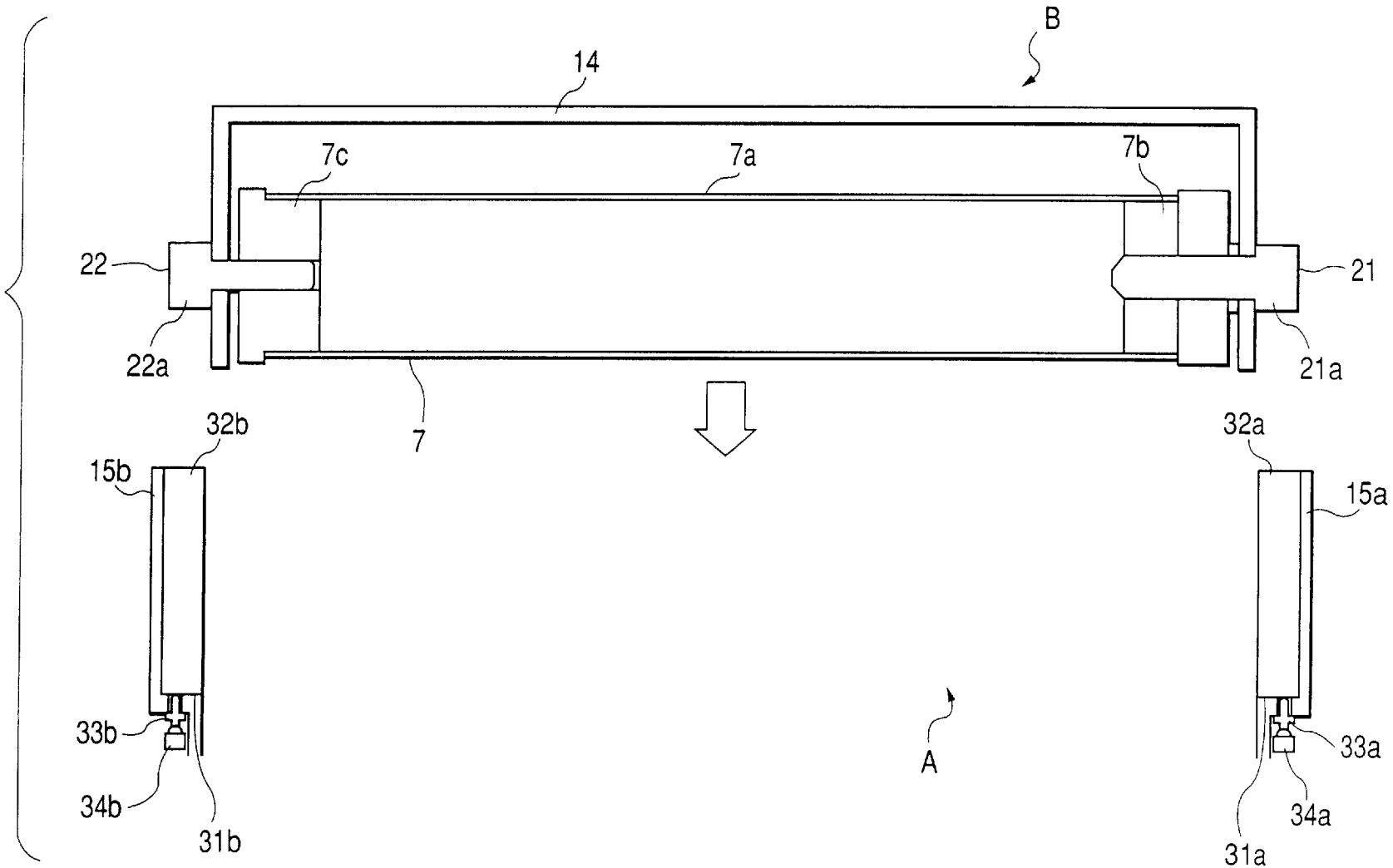
FIG. 2 is a schematic cross-sectional view showing the construction of the essential portions of Embodiment 1 of the present invention (before mounting).

The process cartridge B, as shown in FIG. 2, is of a construction in which the photosensitive drum 7 having flanges 7*b* and 7*c* secured to the opposite end portions of a photosensitive portion 7*a* having a photosensitive layer on the outer periphery of a hollow aluminum cylinder is supported by two support shafts 21 and 22 fixed to the cleaning frame 14 as by press-in. The outer periphery of the flange 7*b* is a gear meshing with the driving portion, not shown, of the main body 17 of the image forming apparatus. The two support shafts 21 and 22 are of a two-step shaft shape having the same axis as the axis of the photosensitive drum 7, and have large-diametered portions 21*a* and 22*a* as projected portions protruding to the outside of the cleaning frame 14. Also, the process cartridge B is provided with a leg portion 23 (see FIGS. 3 and 4) at a location as far as possible from the large-diametered portions 21*a* and 22*a*. These large-diametered portions 21*a* and 22*a* are positioning portions for contacting positioning portions of the main body 17 of the image forming apparatus to thereby effect the positioning of the process cartridge B.

Figure 3:
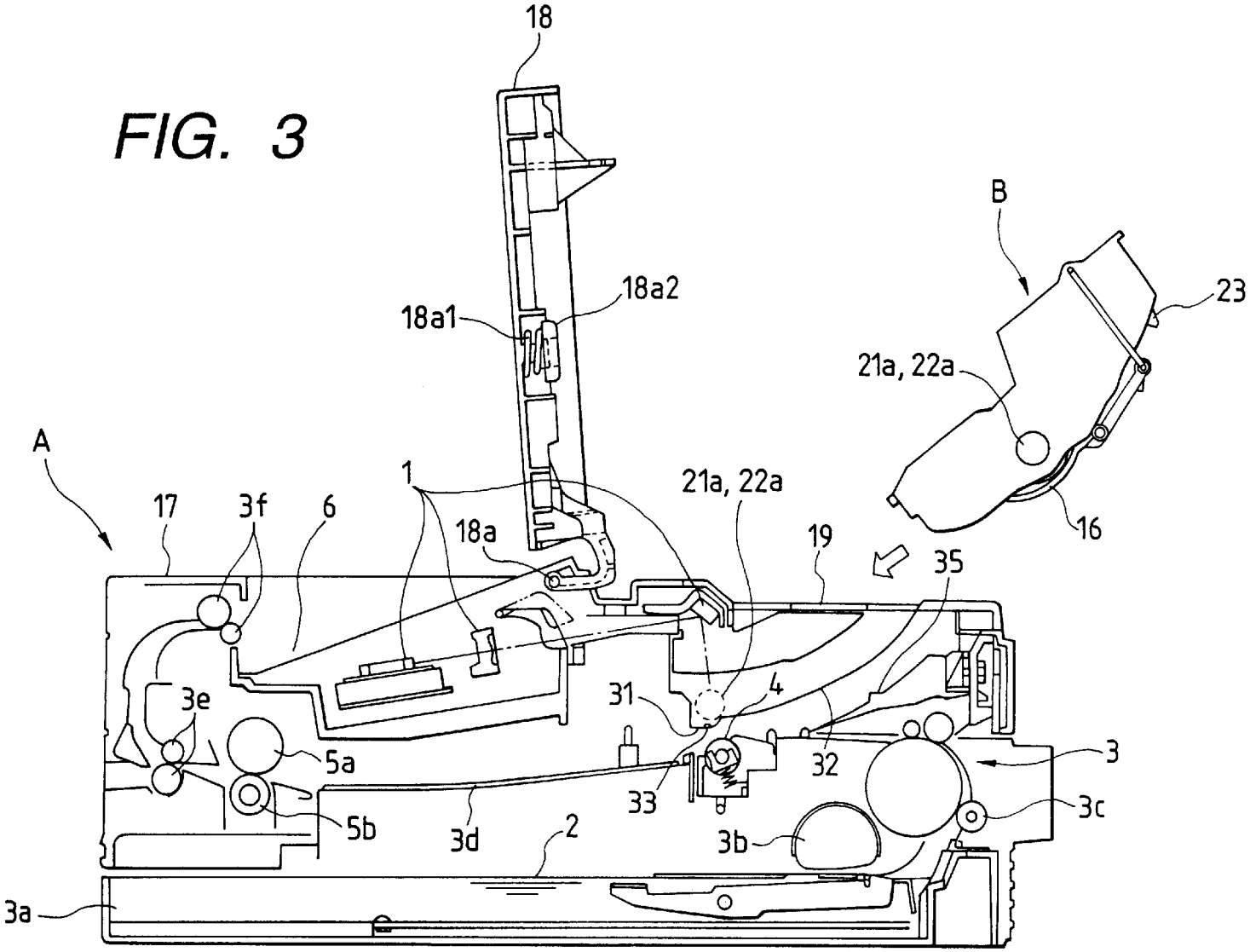
FIG. 3 shows the state before a process cartridge is mounted on an image forming apparatus according to Embodiment 1 of the present invention.
Figure 4:
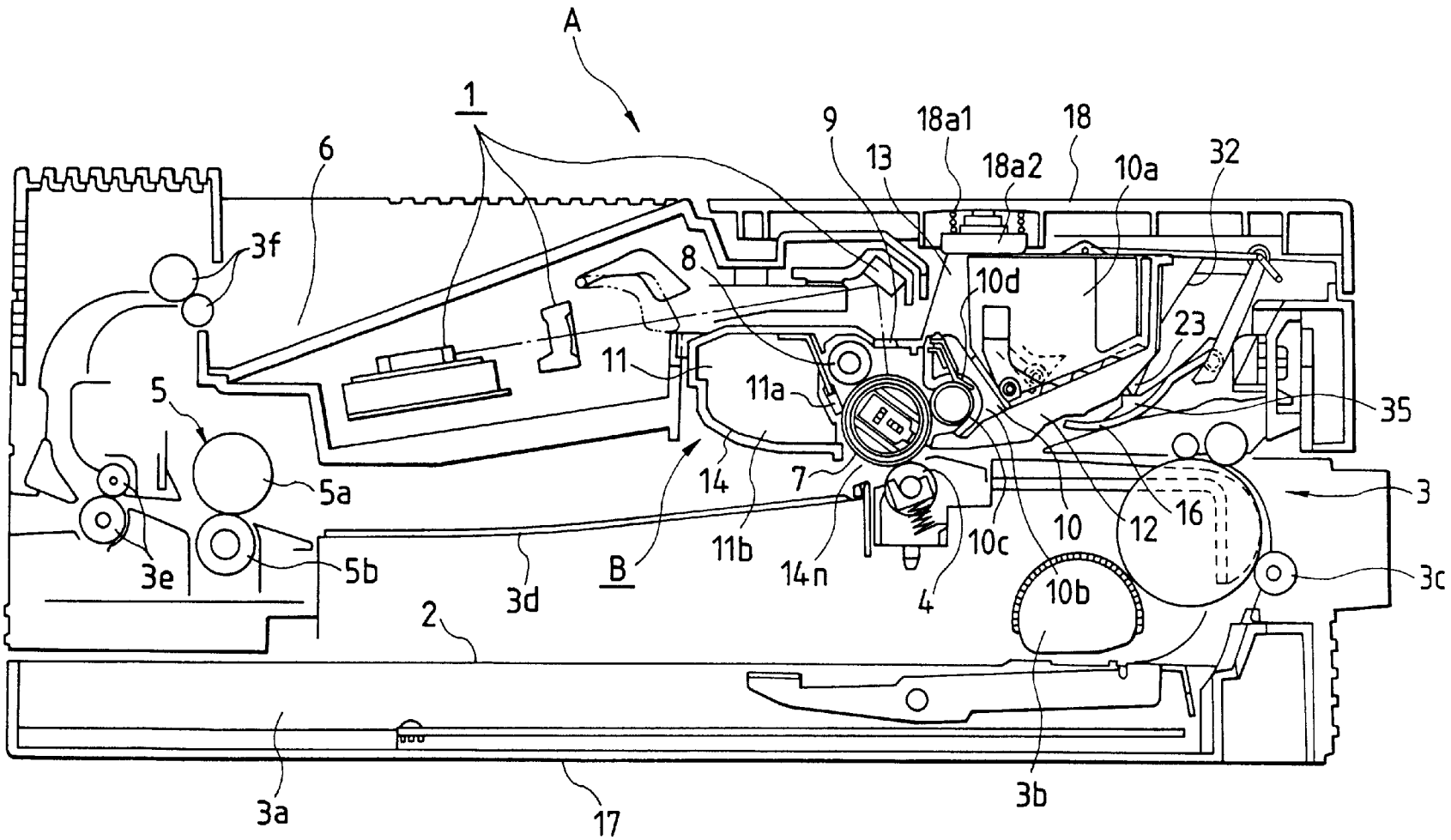
FIG. 4 is a vertical cross-sectional view showing a state during the image formation of the image forming apparatus according to Embodiment 1 of the present invention.

The main body 17 of the image forming apparatus, as shown in FIGS. 2 and 3, has positioning portion 31 (a positioning portion 31*a* on one end in the longitudinal direction and a positioning portion 31*b* on the other end) for supporting the large-diametered portions 21*a* and 22*a* to thereby effect the positioning of the process cartridge B, and has guide portions 32 (right and left guide portions 32*a* and 32*b* as viewed from the mounting direction of the process cartridge) leading therefrom to an opening portion 19 for mounting and dismounting the process cartridge B therethrough.

At predetermined locations on the positioning portions 31*a* and 31*b*, as shown in FIGS. 3 and 2, there are provided slide pins 33 (33*a* and 33*b*) as actuators slightly protruding from the positioning portions 31 (31*a* and 31*b*). These slide pins 33*a* and 33*b*, when pushed in to the surfaces of the positioning portions 31*a* and 31*b*, push switches 34*a* and 34*b* provided on the opposite side thereof and render them from their switched-OFF state into their switched-ON state. However, the switches 34*a* and 34*b* have resilient members, such as springs, therein and upwardly push the slide pins 33*a* and 33*b* so that they may not be rendered into the switched-ON state by only the force of gravity acting on the slide pins 33*a* and 33*b*. These switches 34*a* and 34*b* conduct to the process cartridge, the presence detecting circuit of the main body 17 of the image forming apparatus.

Figure 5:
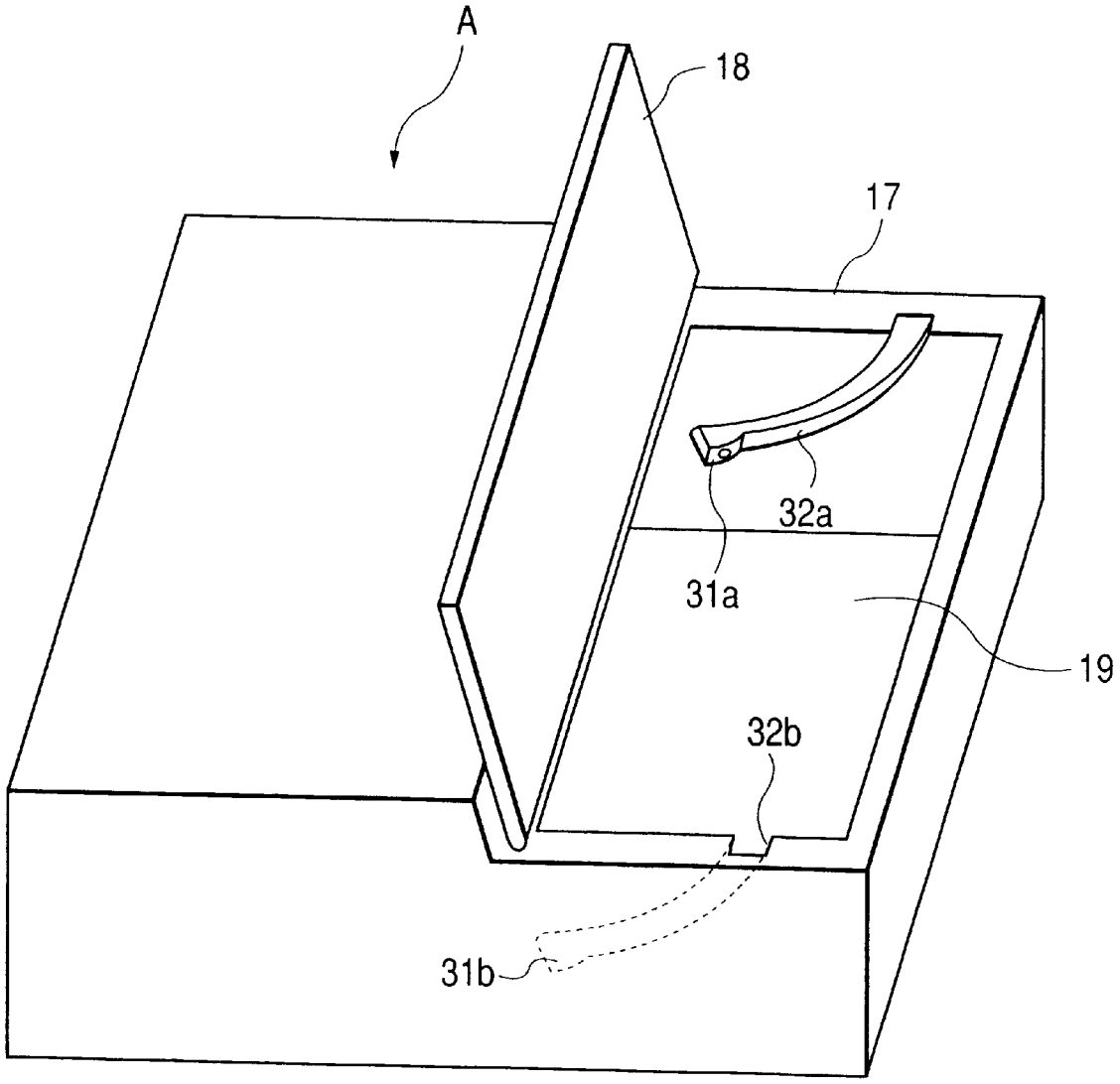
FIG. 5 is a perspective view showing a state in which a lid of the image forming apparatus according to Embodiment 1 of the present invention is opened.

As shown in FIG. 3, a lid 18 is openably and closably supported on the main body 17 of the image forming apparatus by a hinge 18*a*, and FIGS. 3 and 5 show a state in which the lid 18 is opened, and FIG. 4 shows a state in which the lid 18 is closed. The lid 18 has a process-cartridge pressing member 18*a*2 biased by a spring 18*a*1. The direction of the bias of the spring 18*a*1 is downward in FIG. 4 (substantially rightward in FIG. 3).

Figure 6:
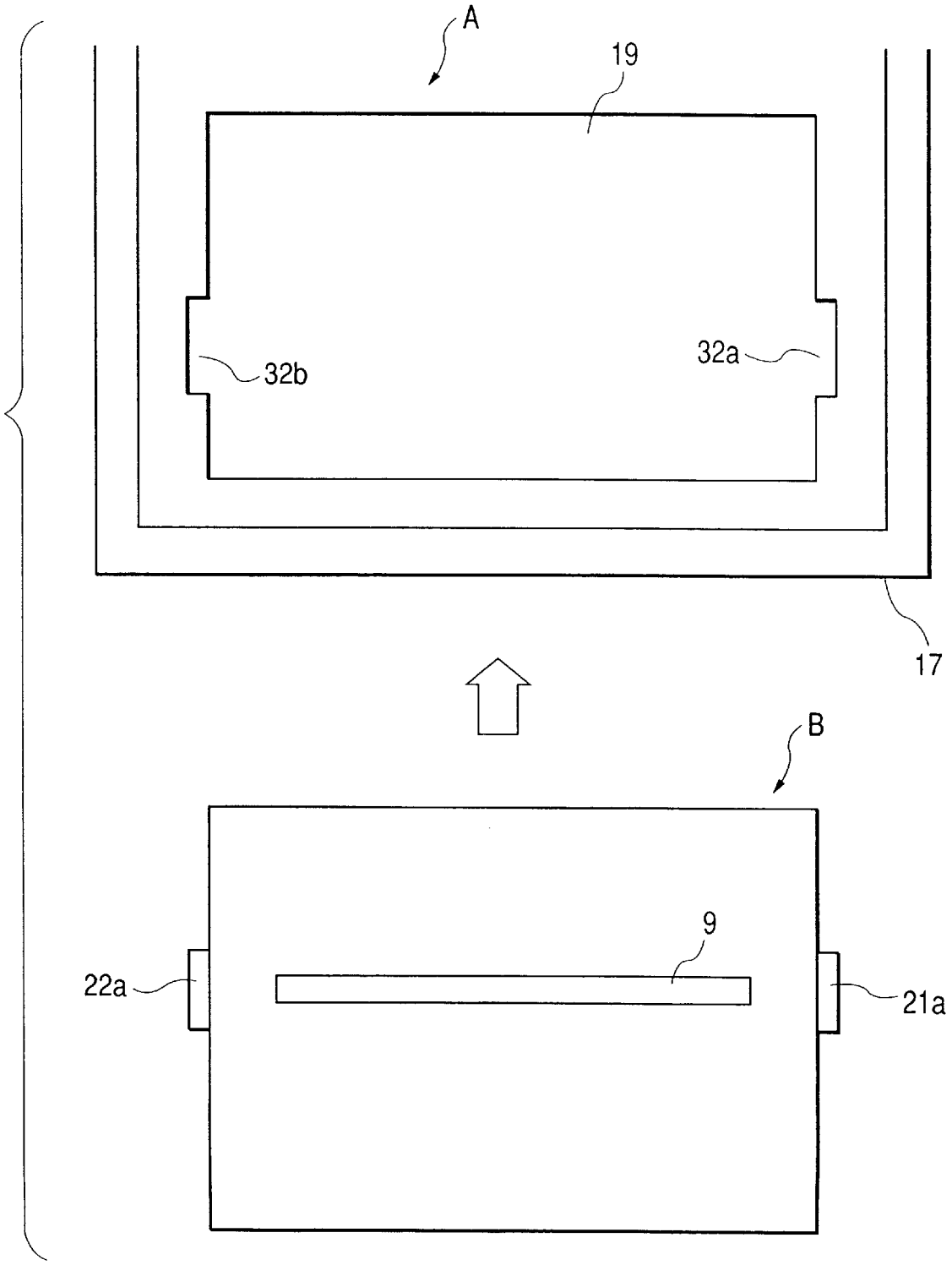
FIG. 6 is a typical view illustrating the construction of a mounting guide for a process cartridge with respect to the image forming apparatus according to Embodiment 1 of the present invention.

In FIG. 3, an operator holds the process cartridge B and inserts the large-diametered portions 21*a* and 22*a* of the process cartridge B in the direction indicated by the arrow in FIGS. 2, 3 and 6 from the opening portion 19 along the guide portions 32 (32*a* and 32*b*). The operator inserts the process cartridge B to the last and releases his hand from the process cartridge B. In that state, the process cartridge B is subjected to an upward force by the transfer roller 4, etc., and therefore, the large-diametered portions 21*a* and 22*a* do not completely contact the positioning portions 31 (31*a* and 31*b*) and are in a little floated-up state as indicated by broken line in FIG. 3. At this time, the large-diametered portions 21*a* and 22*a* do not contact the slide pins 33 (33*a* and 33*b*) which are actuators. Next, when the operator closes the lid 18, the process-cartridge pressing member 18*a*2 contacts the process cartridge B, and when, as shown in FIG. 4, the lid 18 is completely closed, the process-cartridge pressing member 18*a*2 urges the process cartridge B downwardly. The total of this force and the downward force of gravity on the process cartridge B is set to a value greater than the total of the upward forces of the slide pins 33 and the transfer roller 4 and therefore, the large-diametered portions 21*a* and 22*a* are moved in one positioning direction and push the slide pins 33 into complete contact with the positioning portions 31*a* and 31*b* and at the same time, the leg portion 23 also comes into contact with a leg receiving portion 35, whereby the process cartridge B is accurately positioned relative to the image forming apparatus A. At this time, as shown in FIG. 1, the outer peripheries of the large-diametered portions 21*a* and 22*a* become detecting action portions and push the slide pins 33*a* and 33*b*, which are actuators, to the surfaces of the positioning portions 31*a* and 31*b* to thereby close the switches 34*a* and 34*b*. Besides these switches, there is provided a switch (not shown) for detecting the opening of the door adapted to be closed when the lid 18 is closed, and when the both switches are closed, the image forming apparatus A enters a preparatory stage for the image forming process.

Let it be assumed here that one of the large diametered portions 21*a* and 22*a* of the process cartridge B is pushed into a proper position, while the other large-diametered portion is not pushed into a proper position. In that case, one of the switches 34*a* and 34*b* is closed, but the other switch is not closed and therefore, the image forming apparatus A determines that the process cartridge B is not properly mounted in the main body 17 of the image forming apparatus or is absent in the main body 17 of the image forming apparatus, and does not enter the preparation for the image forming process. Also, when neither of the large-diametered portions 21*a* and 22*a* is pushed into a proper position, or when the process cartridge B is not mounted, neither of the switches 34*a* and 34*b* is closed and therefore, the image forming apparatus A likewise judges that the process cartridge B is not properly mounted in the main body 17 of the image forming apparatus or is absent in the main body 17 of the image forming apparatus, and does not enter the preparation for the image forming process.

In the above-described embodiment, the process-cartridge pressing member 18*a*2, biased by the spring 18*a*1, is provided on the lid 18 to more reliably guide the process cartridge B to a proper position in the main body 17 of the image forming apparatus, but this is not an indispensable construction factor.

While in the above-described embodiment, the portions which are the positioning portions of the process cartridge B are provided by the two support shafts 21 and 22, this is not restrictive, but they may be provided on the frame member of the process cartridge and the cleaning frame 14 as in an embodiment which will be described later.

While in the above-described embodiment, the leg portion 23 is provided at a location as far as possible from the large-diametered portions 21*a* and 22*a*, it is only desirable, and the leg portion 23 may be provided near the large-diametered portions if it is possible to provide the necessary positional accuracy of the process cartridge B.

While in the above-described embodiment, the slide pins 33*a* and 33*b* are designed to directly push the switches 34*a* and 34*b*, this is not restrictive, but a resilient member, such as a coil spring, may be interposed therebetween.

While in the above-described embodiment, the detecting means is of a contact type provided by a switch, this is not restrictive; for example, a flat reflecting surface as a detecting action portion may be provided within the narrow range of the large-diametered portions to thereby provide a non-contact type in which light as an actuator is applied thereto and detection is effected by reflected light.

(Embodiment 2)

Figure 7:
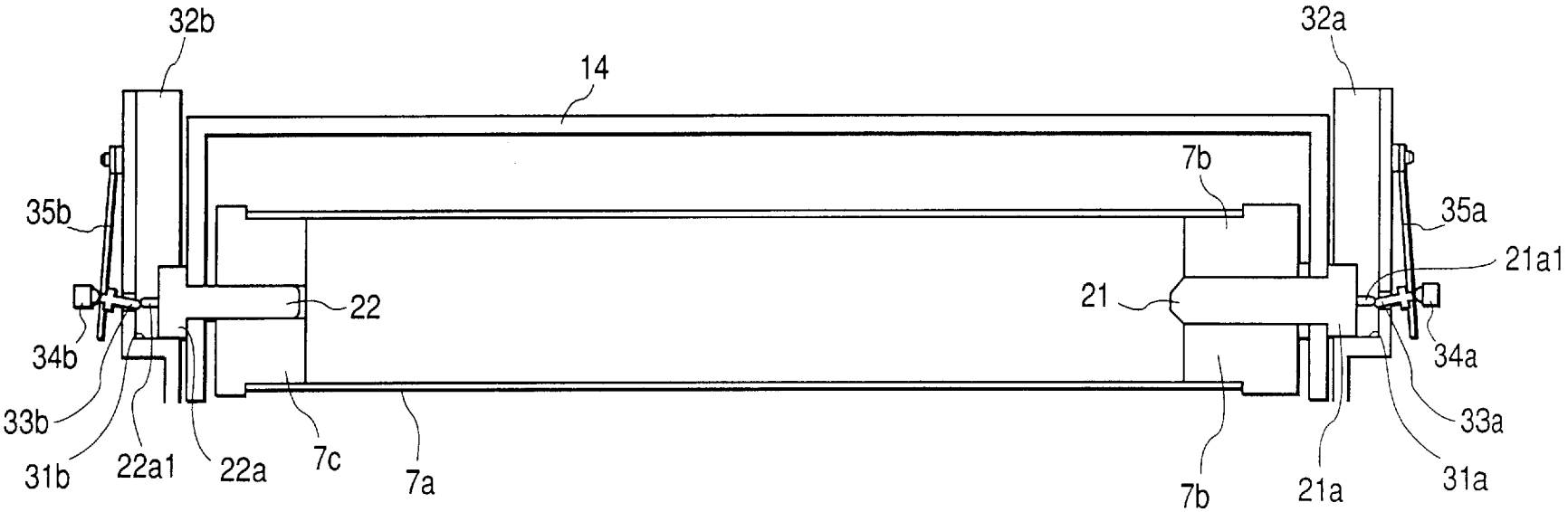
FIG. 7 is a schematic cross-sectional view showing the construction of the essential portions of Embodiment 2 of the present invention (after mounting).
Figure 8:
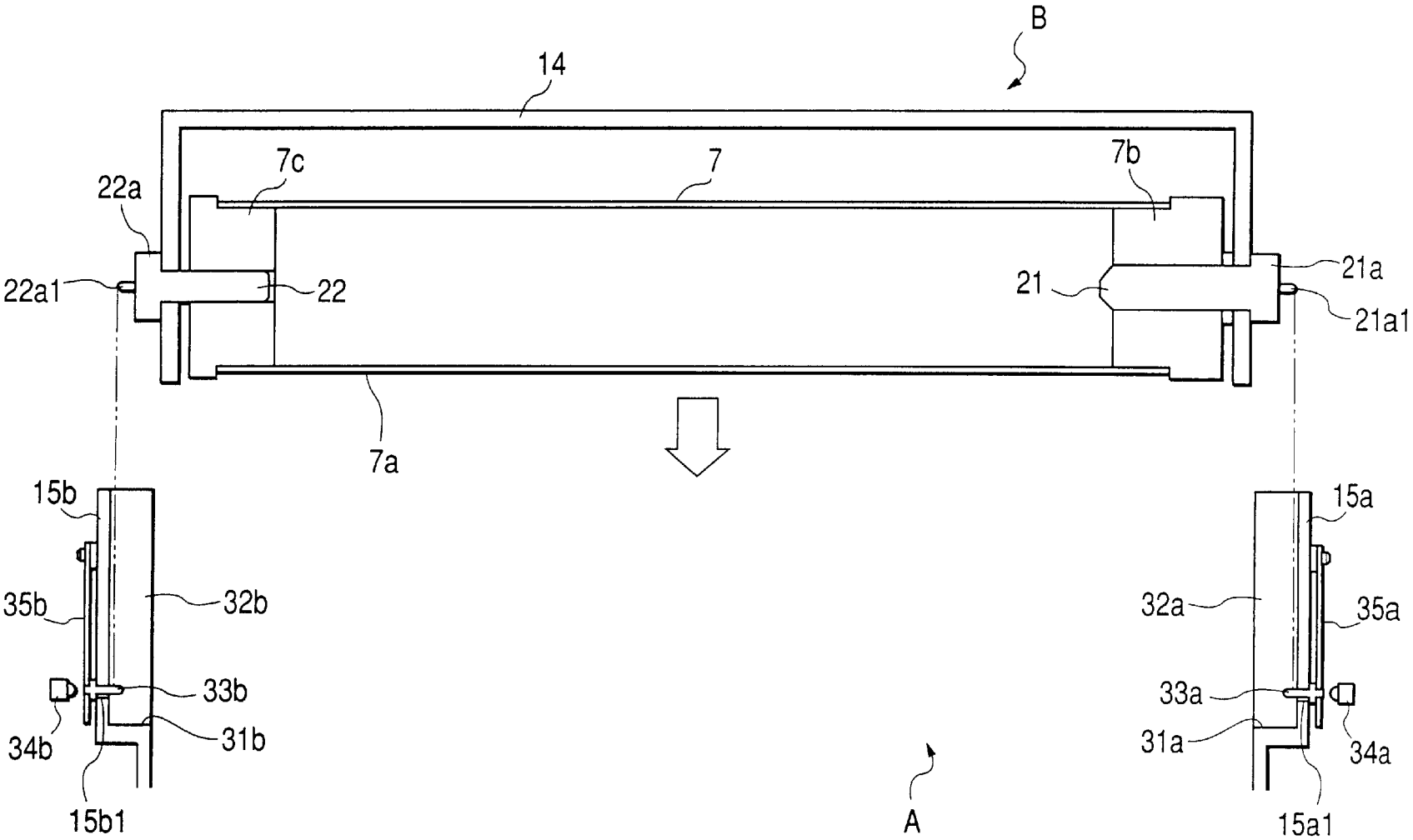
FIG. 8 is a schematic cross-sectional view showing the construction of the essential portions of Embodiment 2 of the present invention (before mounting).

Embodiment 2 will now be described with reference chiefly to FIGS. 7 and 8. FIG. 8 shows the state before a process cartridge B is mounted on the main body 17 of the image forming apparatus, and FIG. 7 shows the state after the process cartridge B has been mounted on the main body 17 of the image forming apparatus. Hereinafter, portions that will not be specially described are the same as those of Embodiment 1.

As shown in FIG. 8, protruding portions 21*a*1 and 22*a*1 extending coaxially with the axis of the photosensitive drum 7 and outwardly from the process cartridge B are provided as detecting action portions on the large-diametered portions 21*a* and 22*a*, respectively, of the support shafts 21 and 22 of the process cartridge B. Slide pins 33*a* and 33*b*, unlike those in Embodiment 1, are provided so as to be inserted into holes 15*a*1 and 15*b*1 formed in guide members 15*a* and 15*b* and protrude inwardly from side portions, which are the groove bottoms of guide portions 32*a* and 32*b*, and are inwardly biased by the distal ends of leaf springs 35*a* and 35*b* to be long as compared with the stroke amounts of the slide pins 33*a* and 33*b*. The leaf springs 35*a* and 35*b* have their proximal ends fixed to the outsides of the guide members 15*a* and 15*b* constituting the guide portions 32*a* and 32*b*. Also, the distal ends of the leaf springs 35*a* and 35*b* are formed with apertures, and the rear end portions reduced in diameter from the flanges of the slide pins 33*a* and 33*b* are fitted in the apertures of the leaf springs 35*a* and 35*b*. As in Embodiment 1, switches 34*a* and 34*b* are provided outside the slide pins 33*a* and 33*b*.

From this state, the operator holds the process cartridge B, and inserts the large-diametered portions 21*a* and 22*a* of the support shafts 21 and 22 of the process cartridge B in the direction indicated by the arrow in FIG. 8 along the guide portions 32*a* and 32*b*. As in Embodiment 1, the process cartridge B is subjected to an upward force by the transfer roller 4, etc. and the large-diametered portions 21*a* and 22*a* thereof may be designed not to completely contact the positioning portions 31*a* and 31*b*, but to be in a little floated-up state, but description overlaps and therefore, consider here a case where the gravity of the process cartridge B is sufficiently heavy and if it is inserted to the last, the large-diametered portions 21*a* and 22*a* of the support shafts 21 and 22 of the process cartridge B completely contact the positioning portions 31*a* and 31*b*. Both the protruding portions 21*a*1, 22*a*1 of the process cartridge B and the slide pins 33*a,* 33*b* are small as shown in FIGS. 7 and 8 and therefore, they begin to contact each other slightly before the mounting of the process cartridge B is completed, and when the process cartridge comes to its final position, the slide pins 33*a* and 33*b* push the switches 34*a* and 34*b* into their switched-ON state (the state of FIG. 7). The loci along which the slide pins 33*a* and 33*b* are pushed and moved are a direction intersecting with the direction of mounting of the process cartridge B, and strictly are curves, but can be said to be approximate to the axial direction of the support shafts 21 and 22 of the photosensitive drum 7 because the leaf springs 35*a* and 35*b* are long. That is, the loci of the slide pins 33*a* and 33*b* are an intersecting direction approximate to a direction orthogonal to the direction in which the process cartridge B is mounted and dismounted.

(Embodiment 3)

Figure 9:
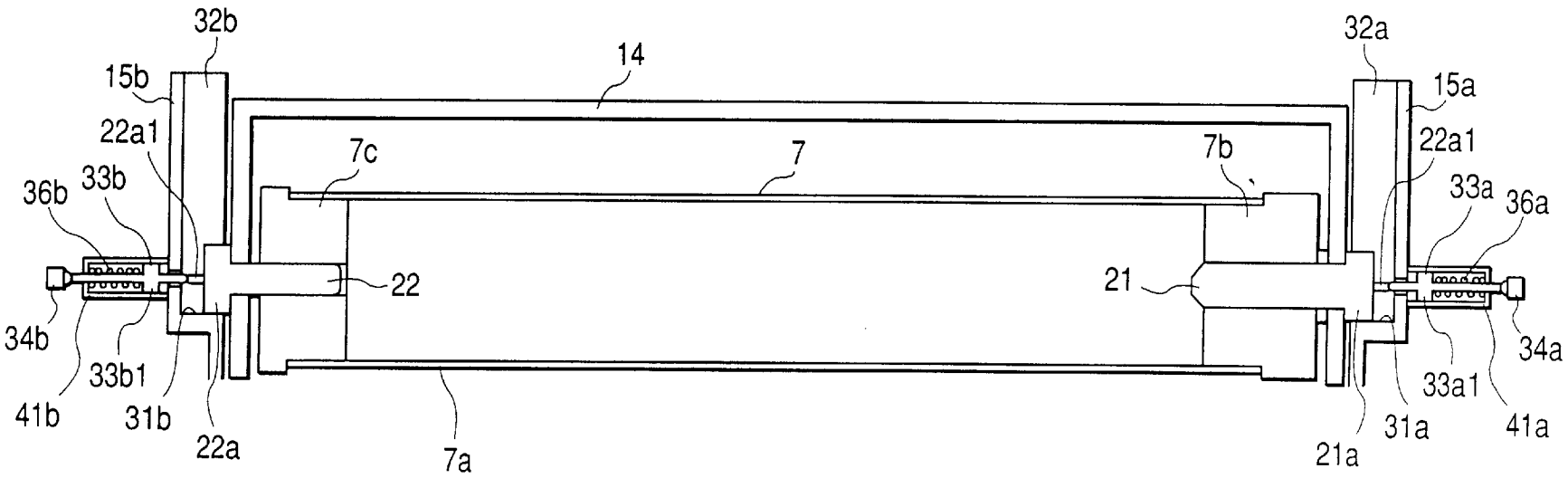
FIG. 9 is a schematic cross-sectional view showing the construction of the essential portions of Embodiment 3 of the present invention (after mounting).
Figure 10:
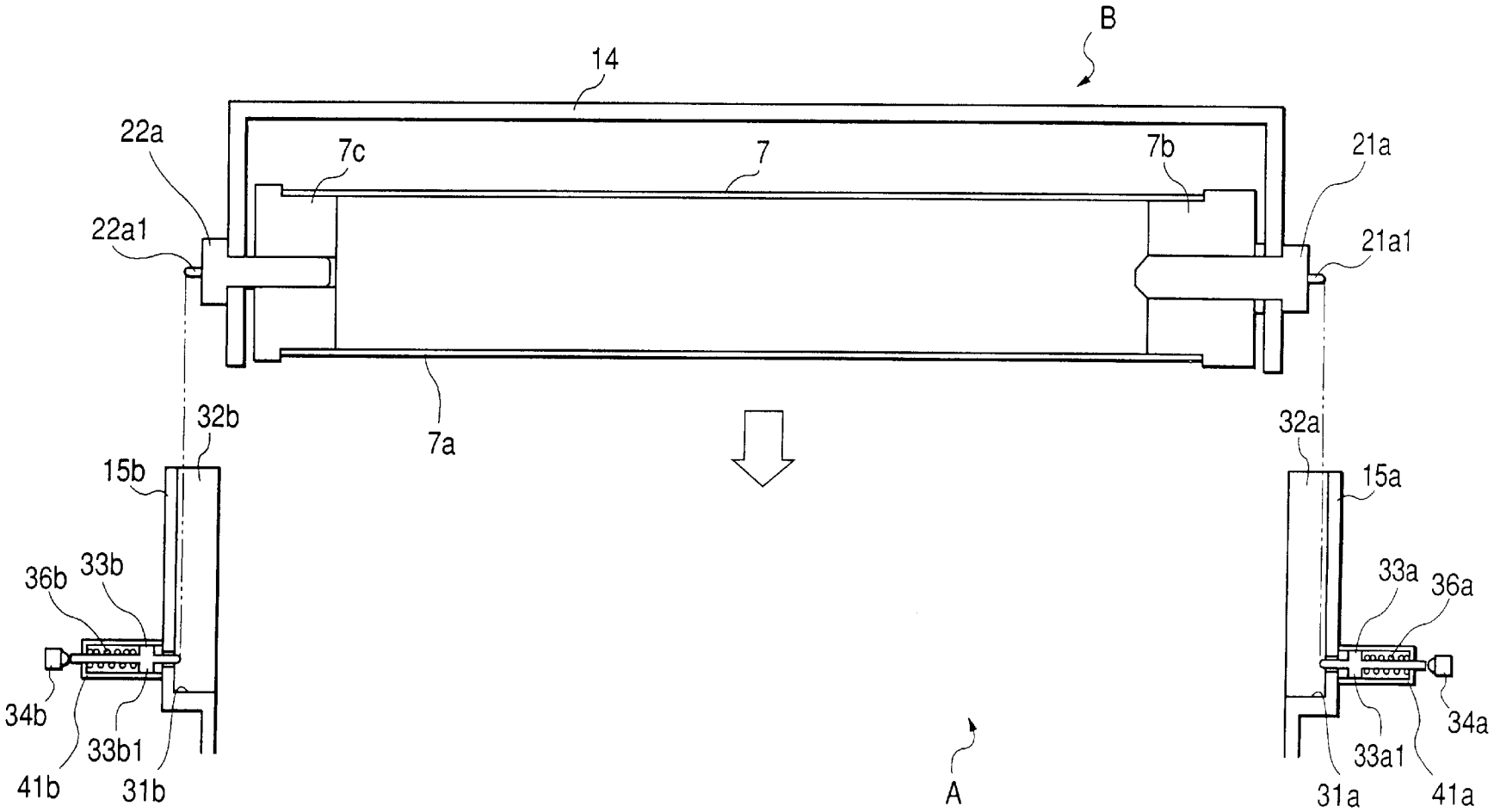
FIG. 10 is a schematic cross-sectional view showing the construction of the essential portions of Embodiment 3 of the present invention (before mounting).

Embodiment 3 will hereinafter be described with reference chiefly to FIGS. 9 and 10. FIG. 10 shows the state before the process cartridge B is mounted on the main body 17 of the image forming apparatus, and FIG. 9 shows the state after the process cartridge B has been mounted on the main body 17 of the image forming apparatus. Portions will not specially be described are the same as those of Embodiment 2.

The present embodiment, as shown in FIGS. 9 and 10, is substantially the same as Embodiment 2, and the difference of the present embodiment from Embodiment 2 is that the slide pins 33*a* and 33*b* of the main body 17 of the image forming apparatus are slidably supported coaxially with the support shafts 21 and 22 of the photosensitive drum 7, and compression coil springs 36*a* and 36*b* are interposed between the slide pins 33*a,* 33*b* and 34*a,* 34*b* in a manner that will be described later. In this case, the loci of the slide pins 33*a* and 33*b* are a direction substantially orthogonal to the direction in which the process cartridge B is mounted and dismounted. The slide pins 33*a* and 33*b* have flanges 33*a*1 and 33*b*1 enlarged in diameter, which provide axially intermediate spring seats. The slide pins 33*a* and 33*b* are axially movably fitted to guide members 15*a* and 15*b* and the distal ends thereof protrude into guide portions 32*a* and 32*b* and the rear ends thereof are axially movably fitted to the end plates of cylinders 41*a* and 41*b* fixed to the guide members 15*a* and 15*b,* and the rear end surfaces thereof are provided in opposed relationship with switches 34*a* and 34*b*. Compression coil springs 36*a* and 36*b* inserted over the slide pins 33*a* and 33*b* are compressedly provided between the flanges 33*a*1, 33*b*1 and the end plates of the cylinders 41*a,* 41*b*.

(Embodiment 4)

Figure 11:
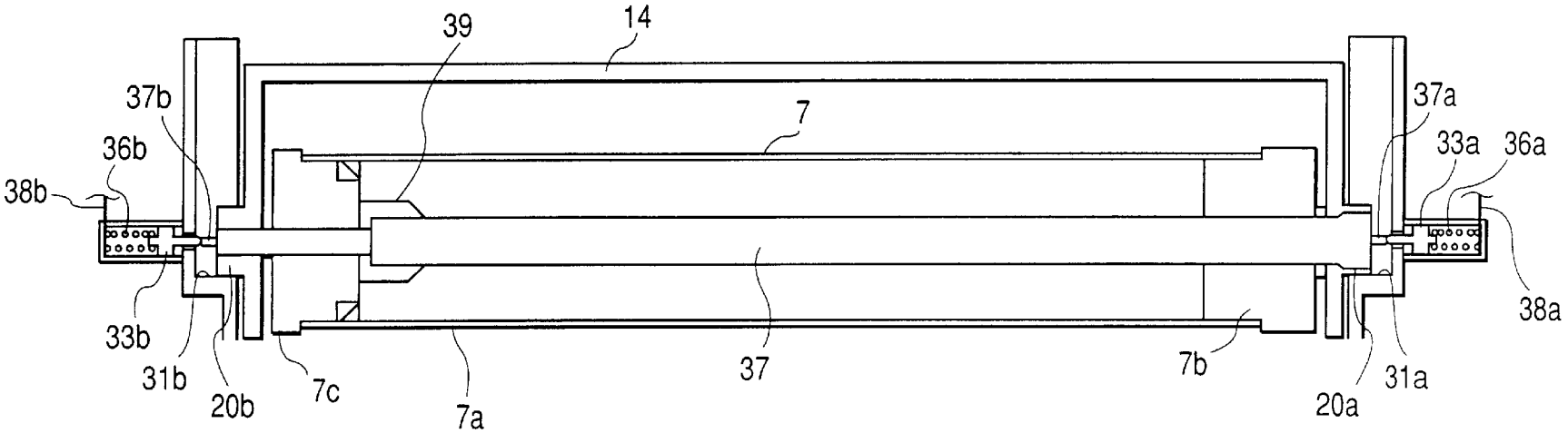
FIG. 11 is a schematic cross-sectional view showing the construction of the essential portions of Embodiment 4 of the present invention (after mounting).
Figure 12:
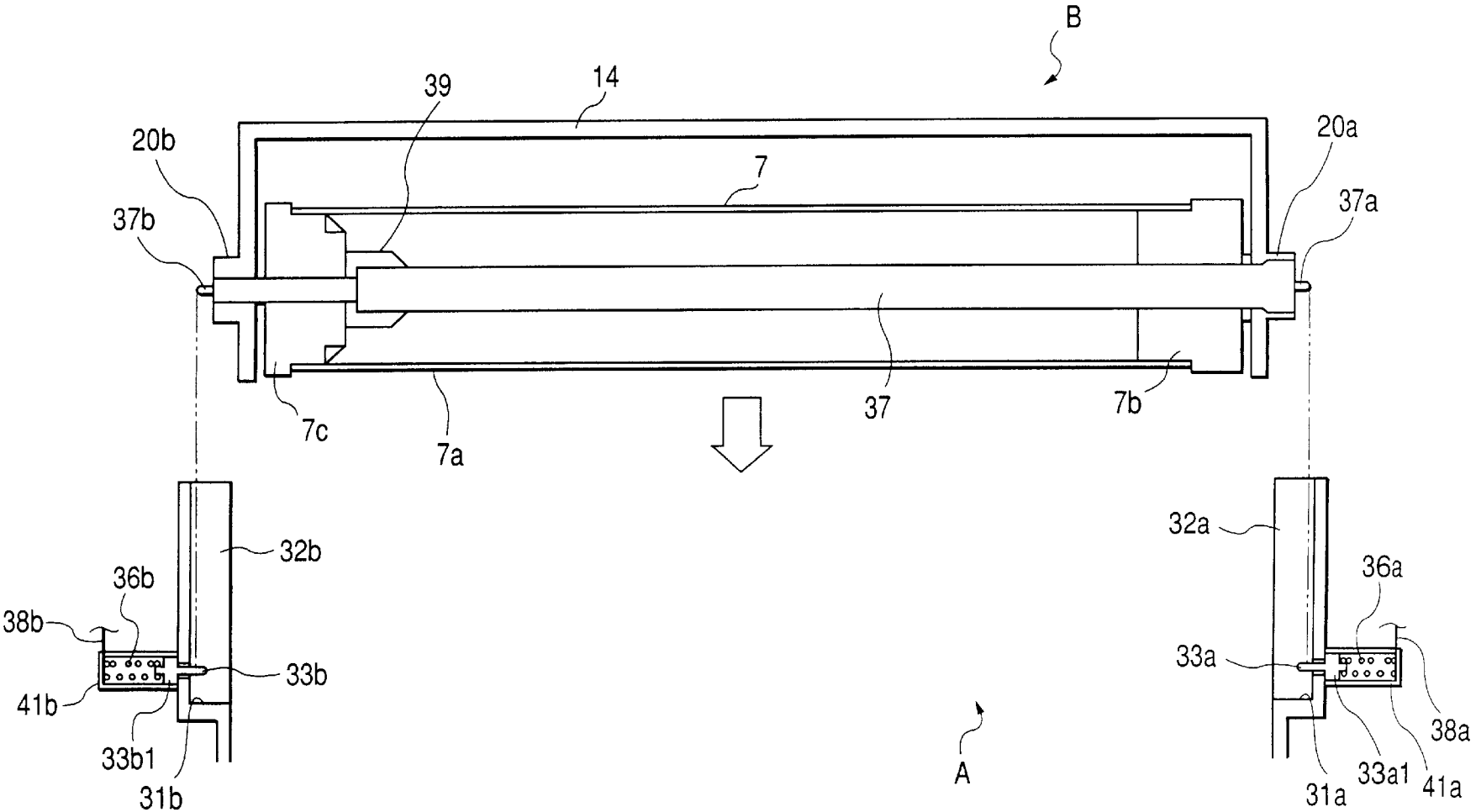
FIG. 12 is a schematic cross-sectional view showing the construction of the essential portions of Embodiment 4 of the present invention (before mounting).

Embodiment 4 will now be described with reference chiefly to FIGS. 11 and 12. FIG. 12 shows the state before the process cartridge B is mounted on the main body 17 of the image forming apparatus, and FIG. 11 shows the state after the process cartridge B has been mounted on the main body of the image forming apparatus. Hereinafter, portions which will not be specially described are the same as those of Embodiment 3.

The process cartridge B, unlike the process cartridges of Embodiments 1 to 3, has a construction as shown in FIG. 12 wherein the photosensitive drum 7 is rotatably supported by a through-shaft 37 fixed to the cleaning frame member 14 as by force-fitting. The through-shaft 37 is formed of a material such as a metal having electrical conductivity, and has the same center as the center of the photosensitive drum 7. Portions corresponding to the large-diametered portions 21*a* and 22*a,* which are the positioning portions of Embodiments 1 to 3, are bosses 20*a* and 20*b* and are provided on the cleaning frame 14 in a cylindrical shape having the same center as the through-shaft 37 of the photosensitive drum 7.

Also, the present embodiment has protruding portions 37*a* and 37*b* extending outwardly of the process cartridge B coaxially with the through-shaft 37 on the opposite end portions thereof as portions corresponding to protruding portions 21*a*1 and 22*a*1 provided on the large-diametered portions 21*a* and 22*a*.

Further, as shown in FIG. 12, one flange 7*c* has secured thereto a ground plate 39 formed of a material, such as a metal, having electrical conductivity, and the ground plate 39 is in contact with the through-shaft 37 and with the inner peripheral surface of the photosensitive portion 7*a* comprising a hollow aluminum cylinder provided with a photosensitive layer on the outer periphery thereof.

The present embodiment is the same as Embodiment 3 in that the slide pins 33*a* and 33*b* are slidably supported coaxially with the axis of the photosensitive drum 7 of the process cartridge B as it is mounted on the main body 17 of the image forming apparatus, and are inwardly biased by compression coil springs 36*a* and 36*b,* except that the other end portions contacting with the compression coil springs 36*a* and 36*b* do not contact switches 34*a* and 34*b,* but electrode plates 38*a* and 38*b* provided on the end plates of cylinders 41*a* and 41*b*. The slide pins 33*a,* 33*b,* the compression coil springs 36*a,* 36*b* and the electrode plates 38*a,* 38*b* have electrical conductivity, and at least one of the electrode plates 38*a* and 38*b* can be grounded, and the design is made such that the resistance between the electrode plates 38*a* and 38*b* can be examined.

In such a construction, as in Embodiment 3, the operator inserts the process cartridge B in the direction indicated by the arrow in FIG. 12, whereby the bosses 20*a* and 20*b* of the process cartridge B completely contact the positioning portions 31*a* and 31*b* (the state of FIG. 11). With that operation, both protruding portions 37*a,* 37*b,* which are the detecting action portions of the process cartridge B, and slide pins 33*a,* 33*b,* which are actuators, begin to contact each other slightly before the mounting of the process cartridge B is completed because they are small as shown in FIGS. 11 and 12.

Thereafter, when the operator closes the lid 18, a door open switch, not shown, becomes closed. In response to the closing of the door open switch, the image forming apparatus A examines the resistance between the electrode plates 38*a* and 38*b*. If the result of the examination is a certain value or less, the image forming apparatus A determines that the process 27 cartridge B is properly mounted in the image forming apparatus A, and enters the preparatory stage for the image forming process. If, conversely, the result is over a certain value, the image forming apparatus determines that the process cartridge B is not properly mounted or the process cartridge B is absent in the main body 17 of the image forming apparatus, and does not enter the preparation for the image forming process.

Also, when the image forming process is being carried out, at least one of the electrode plates 38*a* and 38*b* is grounded. When a latent image is to be formed on the photosensitive drum 7, the charges of the exposed portion are eliminated from the inner surface of the photosensitive portion 7*a* via the ground plate 39, the through-shaft 37 (the protruding portions 37*a* and 37*b* of the through-shaft), the slide pins 33 (33*a* and 33*b*), the compression coil springs 36 (36*a* and 36*b*) and the electrode plates 38*a* and 38*b*.

As described above, in Embodiment 4, means for grounding the photosensitive drum 7, including the drum supporting shaft, can be utilized as means for determining whether the process cartridge B is properly mounted.

While the above-described embodiment uses the ground plate 39, the ground plate 39 may be eliminated with one of the flanges 7*b* and 7*c* formed of an electrically conductive material. Also, while the 28 resistance between the electrode plates 38*a* and 38*b* has been described as being examined, it is not limited to the resistance that is examined, but of course, the electric current, the impedance or the like may be examined.

(Embodiment 5)

Figure 13:
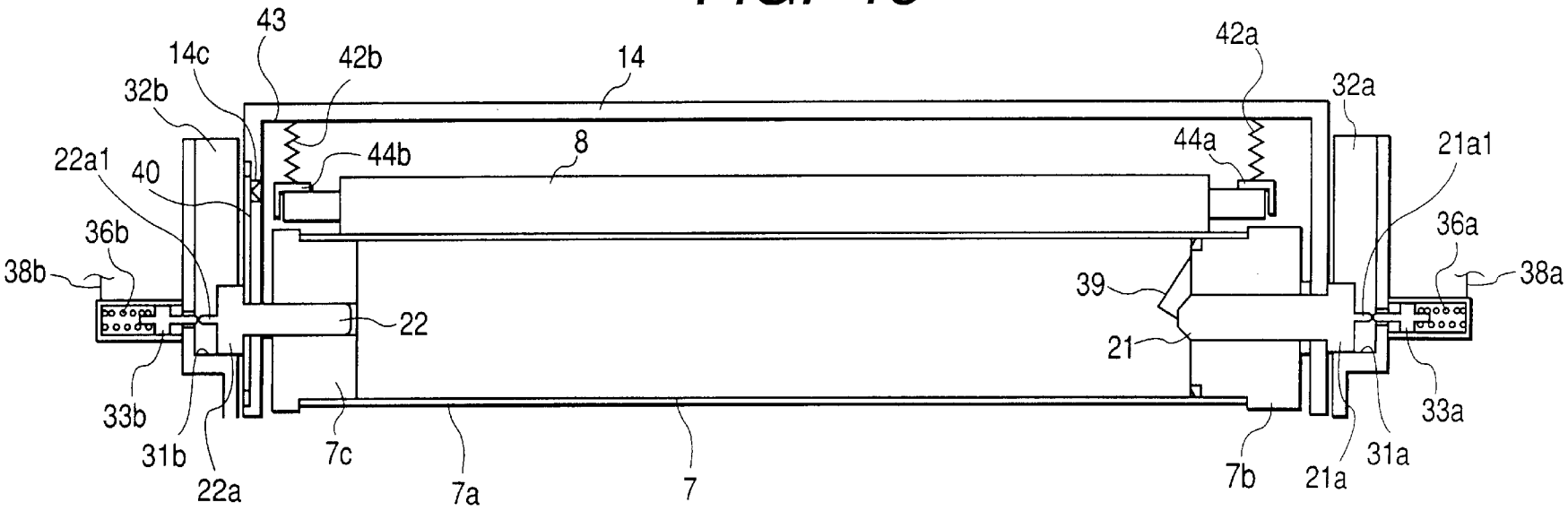
FIG. 13 is a schematic cross-sectional view showing the construction of the essential portions of Embodiment 5 of the present invention (after mounting).
Figure 14:
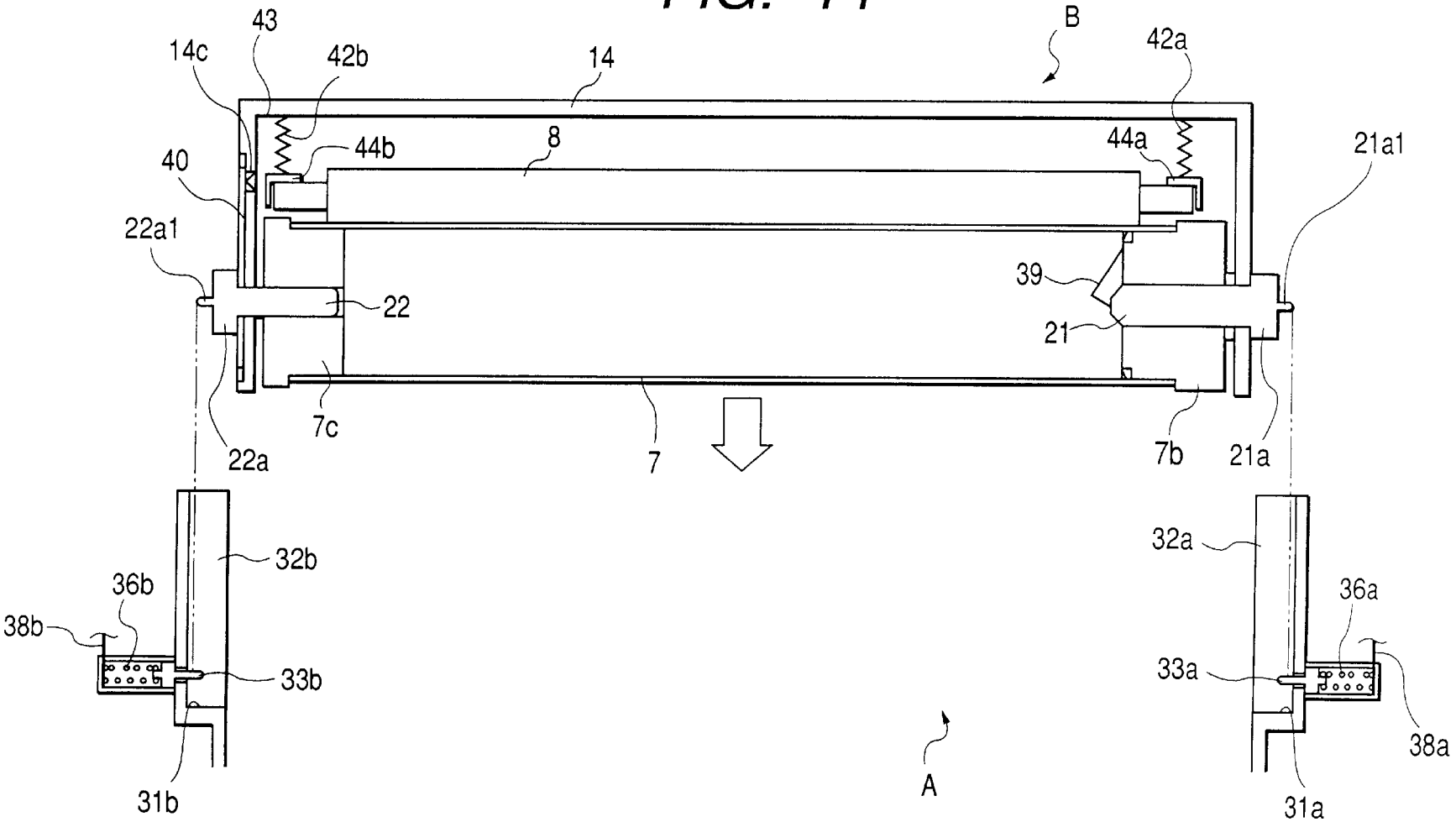
FIG. 14 is a schematic cross-sectional view showing the construction of the essential portions of Embodiment 5 of the present invention (before mounting).

Embodiment 5 will now be described with reference chiefly to FIGS. 13 and 14. FIG. 14 shows the state before the process cartridge B is mounted on the main body 17 of the image forming apparatus, and FIG. 13 shows the state after the process cartridge B has been mounted on the main body 17 of the image forming apparatus. Hereinafter, portions that will not be specially described are the same as those of Embodiment 4.

As regards the process cartridge B, the method of supporting the photosensitive drum 7 and the large-diametered portions 21*a*, 22*a* and the protruding portions 21*a*1, 22*a*1 of the process cartridge B are the same as those in Embodiment 3. The differences of Embodiment 5 from Embodiment 3 are that both of the support shafts 21 and 22 have electrical conductivity, that as shown in FIGS. 13 and 14, the support shaft 21 is in contact with the ground plate 39, and that the support shaft 22 is secured to a metal plate 40 as by caulking and the metal plate 40 is attached to the cleaning frame 14 as by screws.

The charging roller 8 is urged against the photosensitive drum 7 by springs 42*a* and 42*b* through bearings 44*a* and 44*b* movable radially of the photosensitive drum 7 by a guide, not shown, and the bearing 44*b* nearer to the support shaft 22 is formed of an electrically conductive material, and a C electrode 43 is provided on the seat surface for the spring 42*b* pressing the bearing 44*b* and is in contact with the spring 42*b*, and other portion of the C electrode 43 is in contact with the metal plate 40 through an aperture 14*c* cut away in the cleaning frame 14. In such construction, a predetermined voltage is applied to between the photosensitive drum 7 and the charging roller 8 and therefore, the flange 7*c* is formed of an insulative material.

The basic constructions of the slide pins 33*a*, 33*b*, the compression coil springs 36*a*, 36*b* and the electrode plates 38*a*, 38*b* are the same as those in Embodiment 4. However, the electrode plate 38*a* is grounded and the electrode plate 38*b* is connected to a power-source portion including a high-voltage generating circuit, etc., in the main body 17 of the image forming apparatus. In this power-source portion, there is also provided a circuit for detecting the presence or absence of the process cartridge B.

In such a construction, as in Embodiment 4, the operator inserts the process cartridge B into the guide portions 32*a* and 32*b* of the main body 17 of the image forming apparatus in the direction indicated by the arrow in FIG. 14, whereby the large-diametered portions 21*a* and 22*a* of the process cartridge B completely contact the positioning portions 31*a* and 31*b* (the state of FIG. 13). With that operation, the protruding portions 21*a*1, 22*a*1 of the support shafts 21, 22 for supporting the photosensitive drum 7 of the process cartridge B and the slide pins 33*a*, 33*b* begin to contact each other slightly before the mounting of the process cartridge B onto the main body 17 of the image forming apparatus is completed, because both of them are small as shown in FIGS. 13 and 14.

Thereafter, when the operator closes the lid 18, a door open switch, not shown, becomes closed. In response to the closing of the door open switch, the image forming apparatus A applies a predetermined voltage between the photosensitive drum 7 and the charging roller 8, i.e., between the electrode plates 38*a* and 38*b*, for a certain short time and examines an electric current. If the result of the examination is a certain value or greater, the image forming apparatus A determines that the process cartridge is properly mounted therein, and enters the preparatory stage for the image forming process. If conversely, the result is below a certain value, the image forming apparatus determines that the process cartridge B is not properly mounted or the process cartridge B is absent in the main body 17 of the image forming apparatus, and does not enter the preparation for the image forming process.

As described above, in the present embodiment, means for applying a charging voltage can be utilized as means for determining whether the process cartridge B is properly mounted.

In the above-described embodiment, the opposite end portions of the process cartridge B having the same central shaft as the support shaft of the photosensitive drum 7 and extending outwardly of the frame are received by the positioning portions provided in the main body 17 of the image forming apparatus, whereby the positioning of the process cartridge B relative to the main body 17 of the image forming apparatus has been effected. However, this is not restrictive, but except in Embodiment 4, the photosensitive drum may be driven by a coupling mechanism having the automatic aligning function to thereby effect the positioning of the process cartridge B. Particularly in Embodiment 5, the design may be made such that the photosensitive drum is grounded by way of a coupling portion having an automatic aligning mechanism proposed in Japanese Patent Application Laid Open No. 9-269320 previously field by the assignee.

In such a construction, as in Embodiment 4, the operator inserts the process cartridge B into the guide positioning portion, but the means for detecting the mounting of the process cartridge may be provided near the positioning portion.

As described above, according to the present invention, whether the process cartridge is properly mounted on the image forming apparatus can be detected highly accurately by a simple construction.

If in the foregoing, the detecting action portion is designed such that the actuator of the cartridge detecting means is displaced in the same direction as the mounting direction of the process cartridge, whether the process cartridge is properly mounted can be detected more accurately.

If in the foregoing, the cartridge detecting means and the detecting action portion are designed to serve also as electrical connection, the manufacturing cost can be made low.

Other embodiments of the present invention will hereinafter be described in detail with reference to the drawings. A laser beam printer will be described as an embodiment of the image forming apparatus.

(Embodiment 6)

Figure 15:
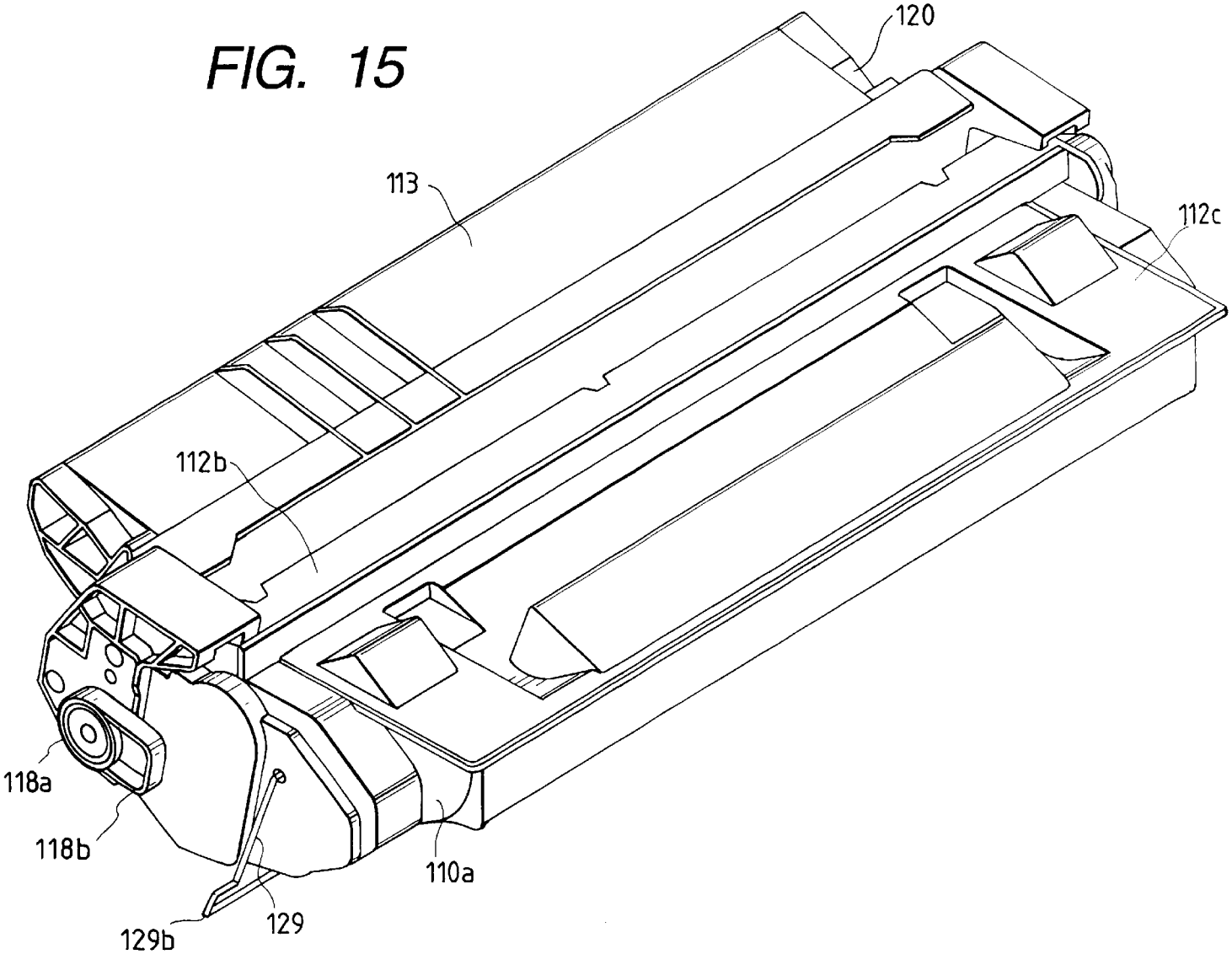
FIG. 15 is a pictorial perspective view showing the left side of a process cartridge according to Embodiment 6 of the present invention.
Figure 16:
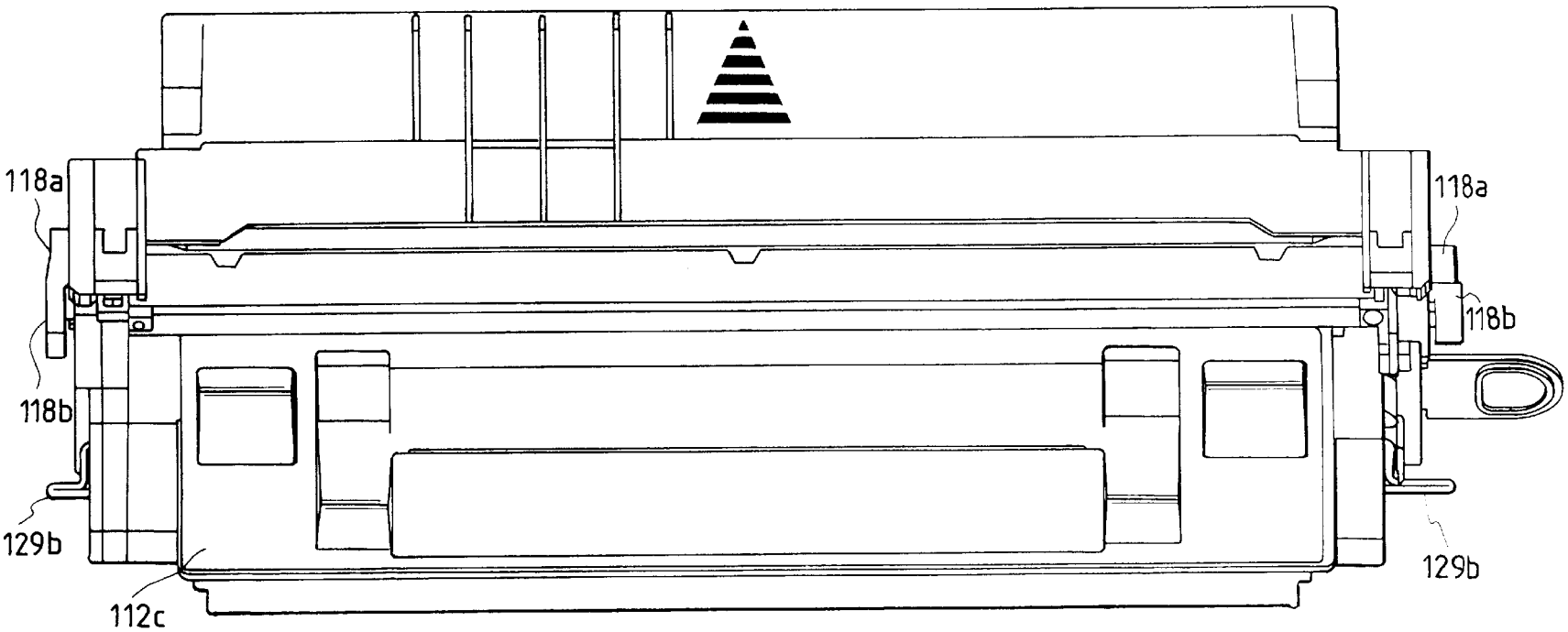
FIG. 16 is a top plan view of the process cartridge according to Embodiment 6 of the present invention.
Figure 17:
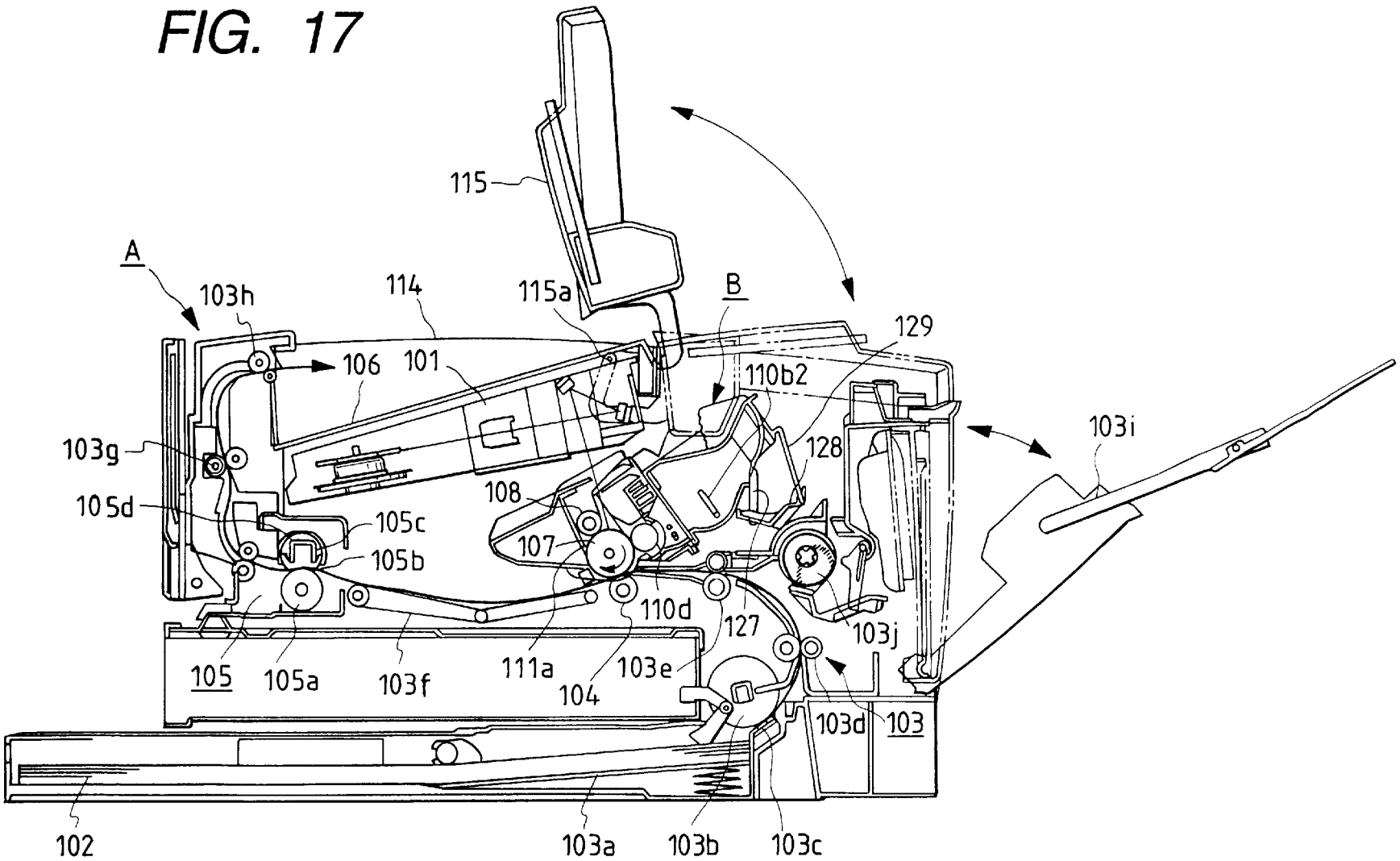
FIG. 17 is a vertical cross-sectional view showing the constructions of the image forming apparatus and the process cartridge.
Figure 18:
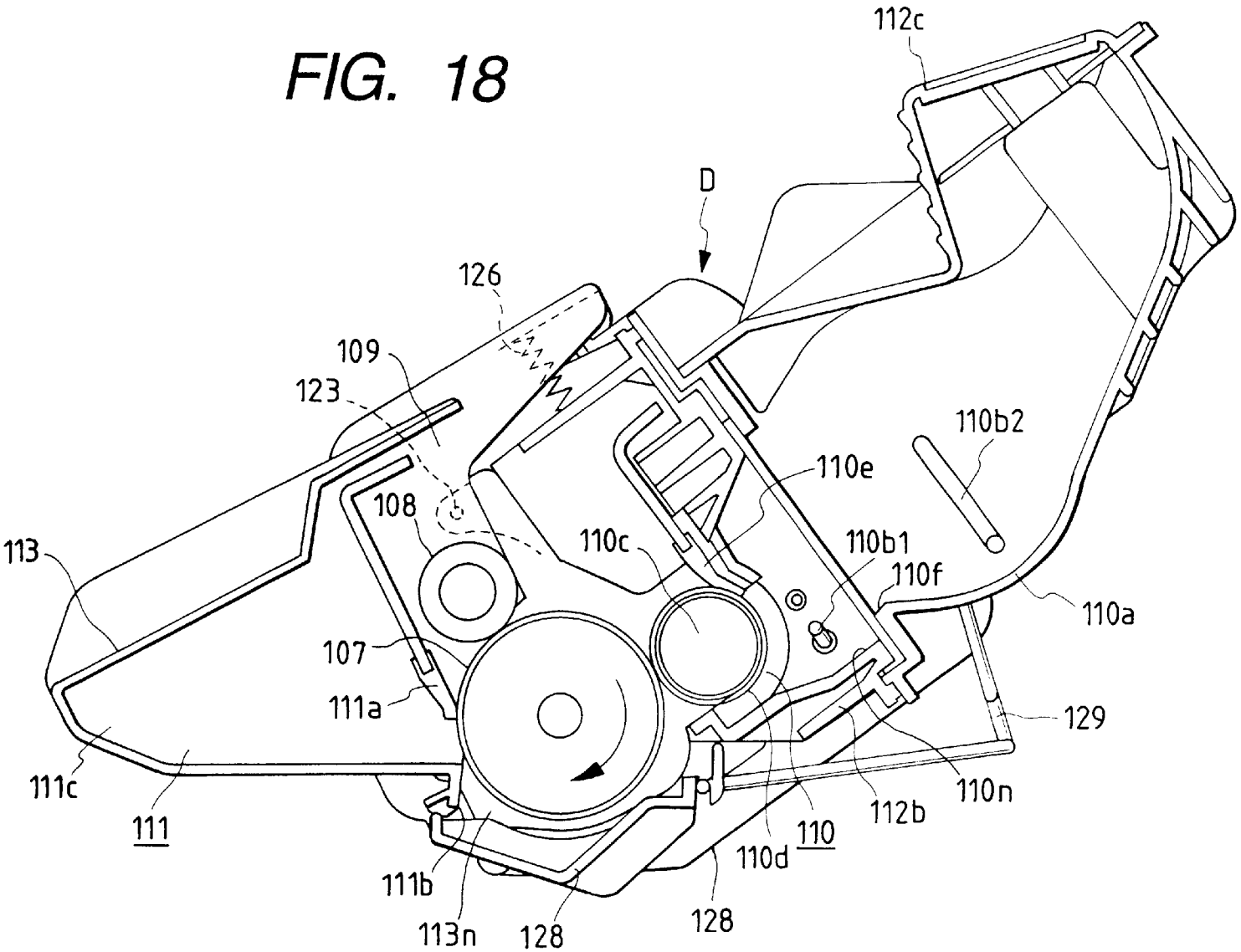
FIG. 18 is a vertical cross-sectional view showing the construction of the process cartridge.

A process cartridge and an image forming apparatus on which it is detachably mountable will be specifically described with reference to FIGS. 15 to 26. FIGS. 15 and 16 are pictorial illustrations of the process cartridge. FIG. 17 is a typical illustration of the construction of the image forming apparatus on which the process cartridge is mounted, FIG. 18 is a typical illustration of the construction of the process cartridge, FIGS. 19 to 26 are illustrations of the construction of mounting means for the process cartridge B, and FIGS. 27 to 30 are detailed views illustrating the present invention.

The process cartridge and the general construction of the image forming apparatus using the same will first be described.

[General Construction]

This electrophotographic image forming apparatus (laser beam printer) A, as shown in FIG. 17, applies information light based on image information from an optical system 101 to a photosensitive drum 107, which is a drum-shaped electrophotographic photosensitive member, to thereby form a latent image on the photosensitive drum 107, and the latent image is then developed by a developer (hereinafter referred to as the "toner") to thereby form a toner image. In synchronism with the formation of the toner image, recording media 102 are separated and fed one by one from a sheet feed cassette 103*a* by a pickup roller 103*b* and an urge member 103*c* urged against the pickup roller 103*b* and are conveyed by conveying means 103 comprising a pair of conveying rollers 103*d* and a pair of registration rollers 103*e,* and the toner image formed on the electrophotographic photosensitive member made into a cartridge as the process cartridge B is transferred to the recording medium 102 by a voltage being applied to a transfer roller 104 as transfer means, and the recording medium 102 is conveyed to fixing means 105 by a conveying belt 103*f.* This fixing means 105 comprises a driving roller 105*a* and a fixing rotary member 105*d* containing a heater 105*b* therein and formed by a cylindrical sheet rotatably supported by a support member 105*c,* and heat and pressure are applied to the passing recording medium 102 to thereby fix the transferred toner image thereon. This recording medium 102 is conveyed by pairs of discharge rollers 103*g* and 103*h* and is discharged to a discharge portion 106 through a surface reversing and conveying path. This image forming apparatus A also enables manual feeding to be effected by a manual feeding tray 103*i* and a roller 103*j.*

[Process Cartridge]

On the other hand, the process cartridge B is provided with the electrophotographic photosensitive member and at least one process means. The process means includes, for example, charging means for charging the electrophotographic photosensitive member, developing means for developing the latent image formed on the electrophotographic photosensitive member, cleaning means for removing any toner residual on the surface of the electrophotographic photosensitive member, etc. The process cartridge according to the present embodiment, as shown in FIG. 18, is designed such that a photosensitive drum 107, which is an electrophotographic photosensitive member having a photosensitive layer, is rotated, a voltage is applied to a charging roller 108, which is charging means, to thereby uniformly charge the surface of the photosensitive drum 107, and the thus charged photosensitive drum 107 is exposed to a light image from the optical system 101 through an exposure opening portion 109 to thereby form a latent image, which is then developed by developing means 110.

The developing means 110 is such that the toner is fed to the opening portion 110*f* of a toner containing frame 110*a* by a rotatable toner feeding member 110*b*2, which is toner feeding means, in the toner containing frame 110*a,* is fed into a toner developing frame 112*b* through the opening portion 110*h* of the toner developing frame 112*b,* and is agitated by a toner agitating member 110*b*1, and a developing roller 110*d,* which is a developing rotatable member containing a stationary magnet 110*c* therein, is rotated and a toner layer, having triboelectric charge imparted thereto by a developing blade 110*c,* is formed on the surface of a developing roller 110*d,* and the toner is transferred to the photosensitive drum 107 in conformity with the latent image to thereby form a toner image and visualize it.

A voltage of the opposite polarity to the toner image is applied to a transfer roller 104 to thereby transfer the toner image to the recording medium 102, and any toner residual on the photosensitive drum 107 is scraped off by a cleaning blade 111*a* and is dipped by a dip sheet 111*b,* and the residual toner on the photosensitive drum 107 is removed by cleaning means 111 for collecting the residual toner into a waste toner containing portion 111*c.*

Such members as the photosensitive drum 107, etc. are contained in a cartridge frame and made into a cartridge comprised of a developing unit D comprising the toner containing frame 110*a* supporting the toner feeding member 110*b*2 so as to be rotatively driven, the toner developing frame 112*b* containing therein developing members, such as the toner agitating member 110*b*1, the developing roller 110*d* and the developing blade 110*e,* and a lid member 112*c* welded together into a unit, and a cleaning frame 113, constituting the waste toner containing portion 111*c* and having the photosensitive drum 107, the cleaning blade 111*a,* the dip sheet 111*b* and the charging roller 108, the developing unit D and the cleaning frame 113 being coupled by a pin 123, a compression coil spring 126 being compressedly provided between the cleaning frame 113 and the developing unit D, and are detachably mounted with respect to cartridge mounting means provided in the image forming apparatus A. A transfer opening portion 113*n* for bringing the photosensitive drum 107 into contact with the transfer roller 104 is opened and closed by a drum shutter member 128. The drum shutter member 128 is supported on the cartridge frame by an arm 127 and a link 129. The drum shutter member 128, the arm 127, the link 129 and the cartridge frame together constitute a quadric chain mechanism.

[Construction for Mounting and Dismounting the Process Cartridge]

A description will now be of a construction for mounting and dismounting the process cartridge B with respect to the image forming apparatus A.

Figure 19:
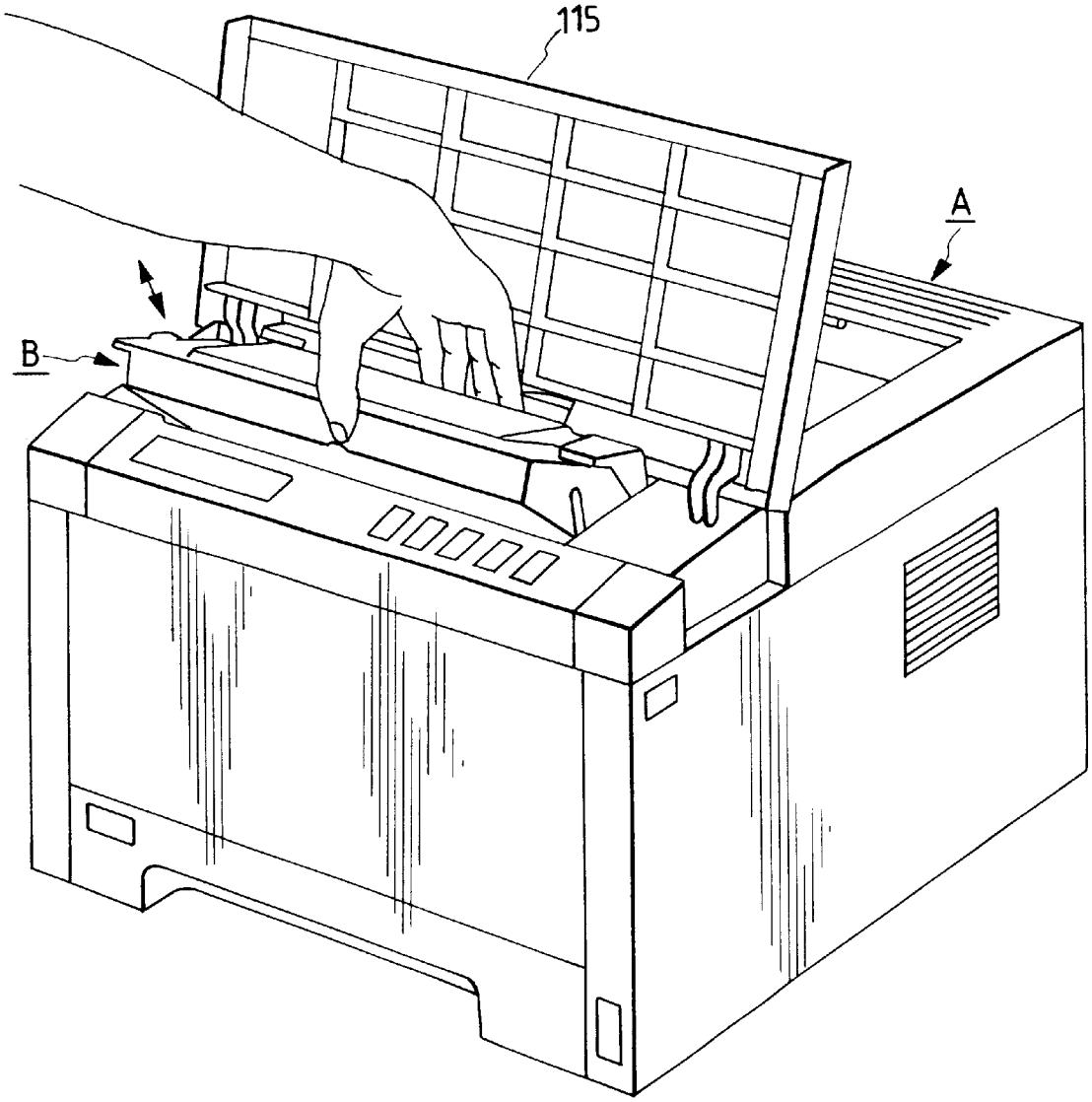
FIG. 19 is a perspective view of the image forming apparatus illustrating a state in which the process cartridge is mounted and dismounted.
Figure 20:
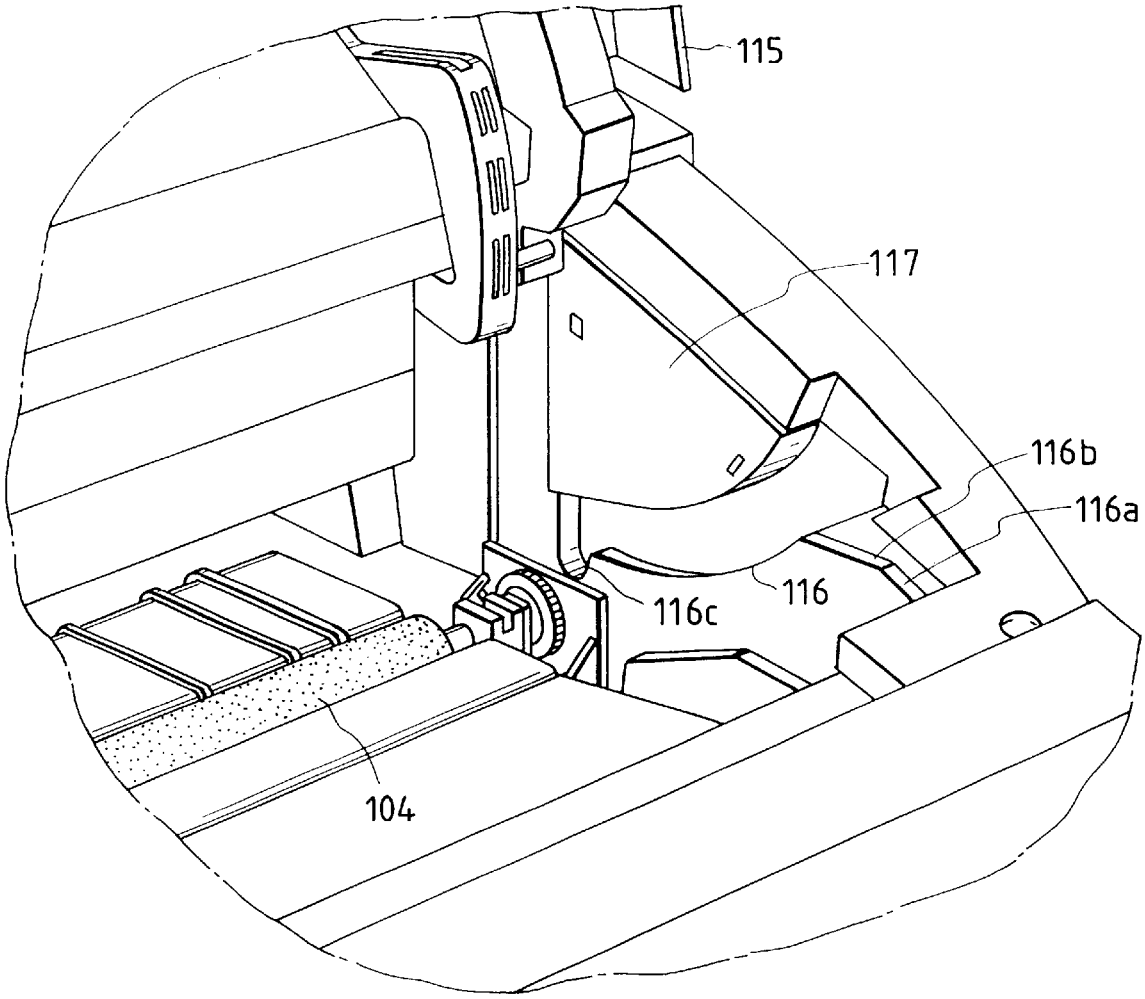
FIG. 20 is a perspective view showing the construction of the right side guide of the image forming apparatus for guiding the mounting and dismounting of the process cartridge.
Figure 21:
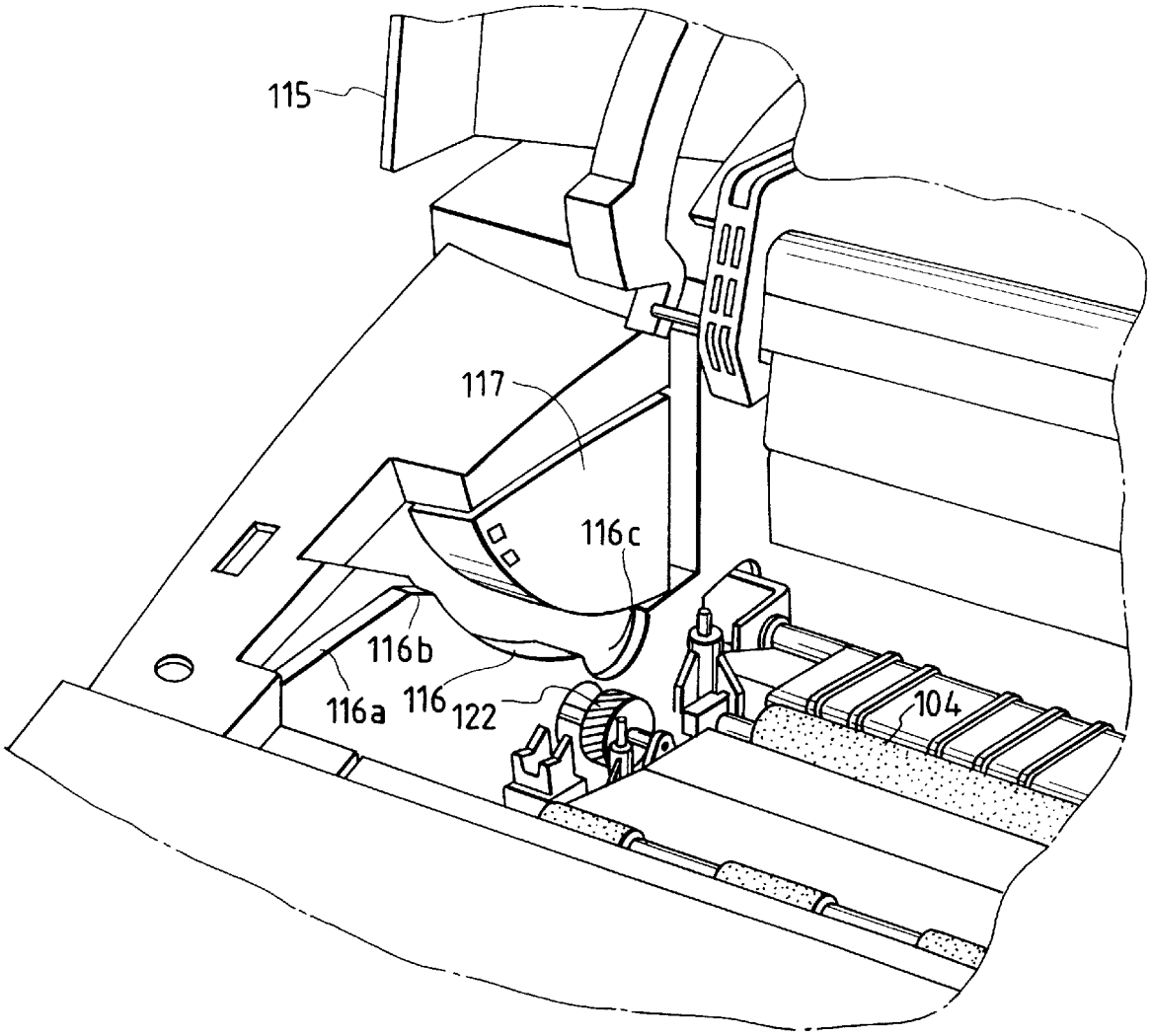
FIG. 21 is a perspective view showing the construction of the left side guide of the image forming apparatus for guiding the mounting and dismounting of the process cartridge.
Figure 22:
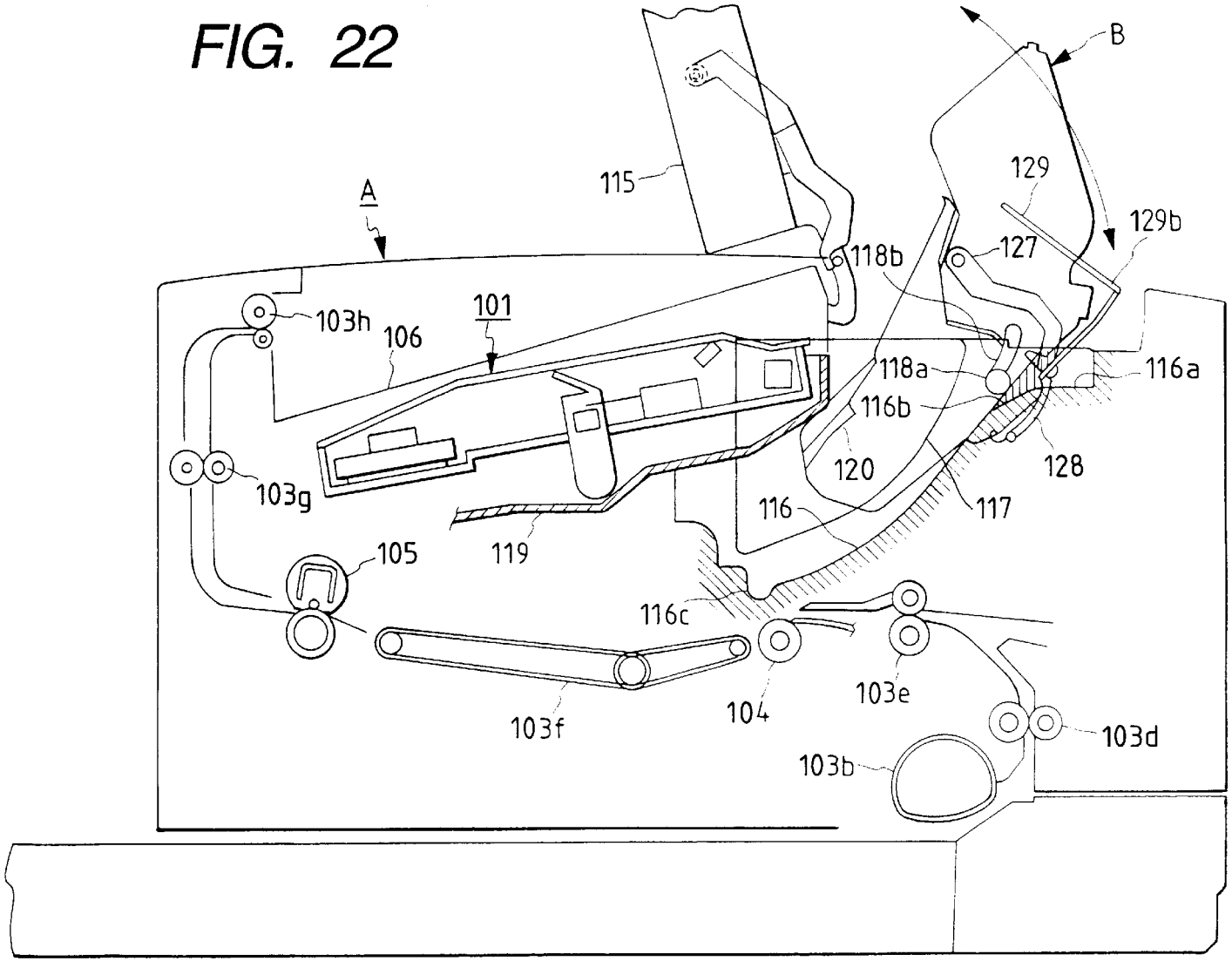
FIG. 22 is an illustration of a state in which the process cartridge is mounted on the image forming apparatus.
Figure 23:
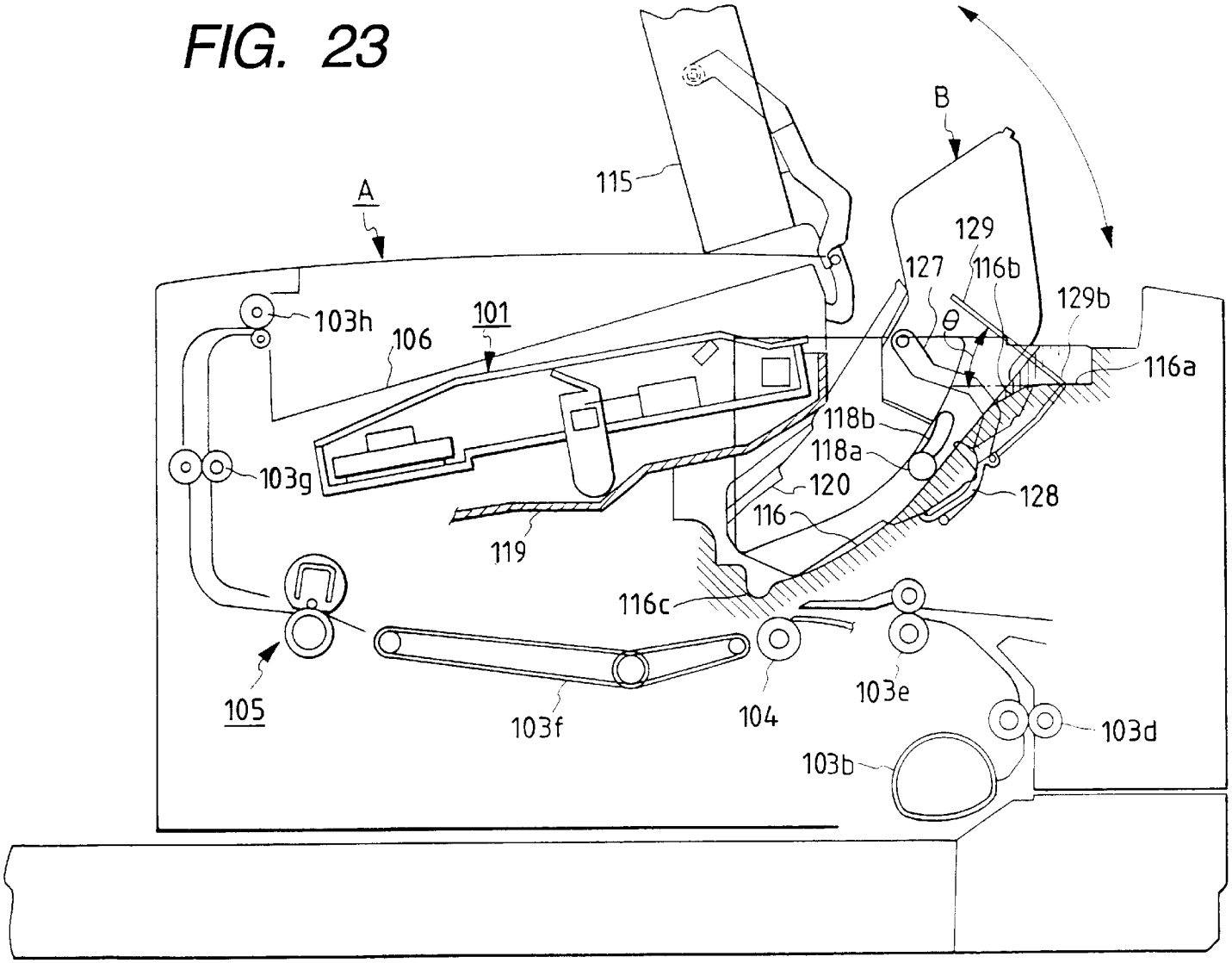
FIG. 23 is an illustration of a state in which the process cartridge is mounted on the image forming apparatus.
Figure 24:
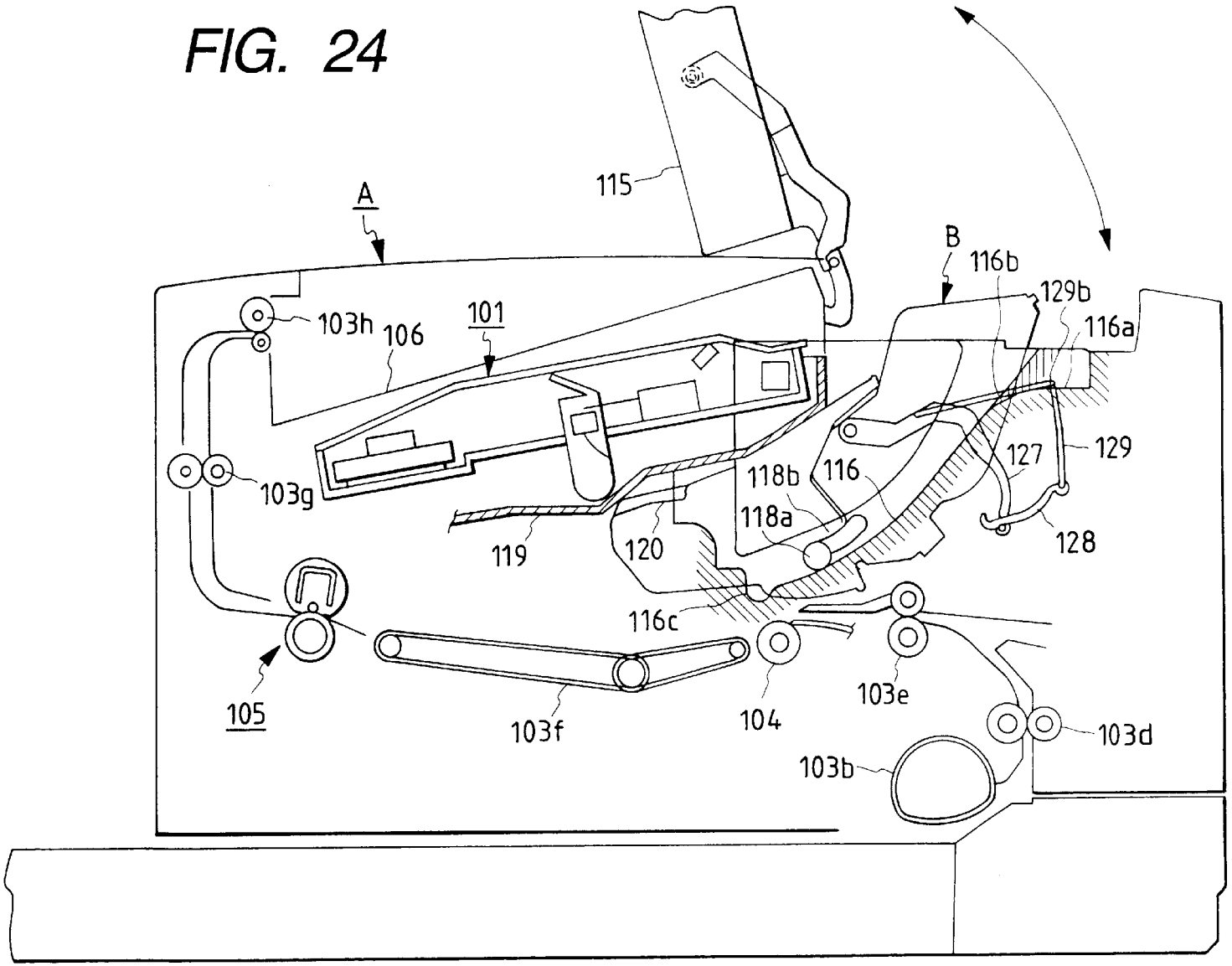
FIG. 24 is an illustration of a state in which the process cartridge is mounted on the image forming apparatus.
Figure 25:
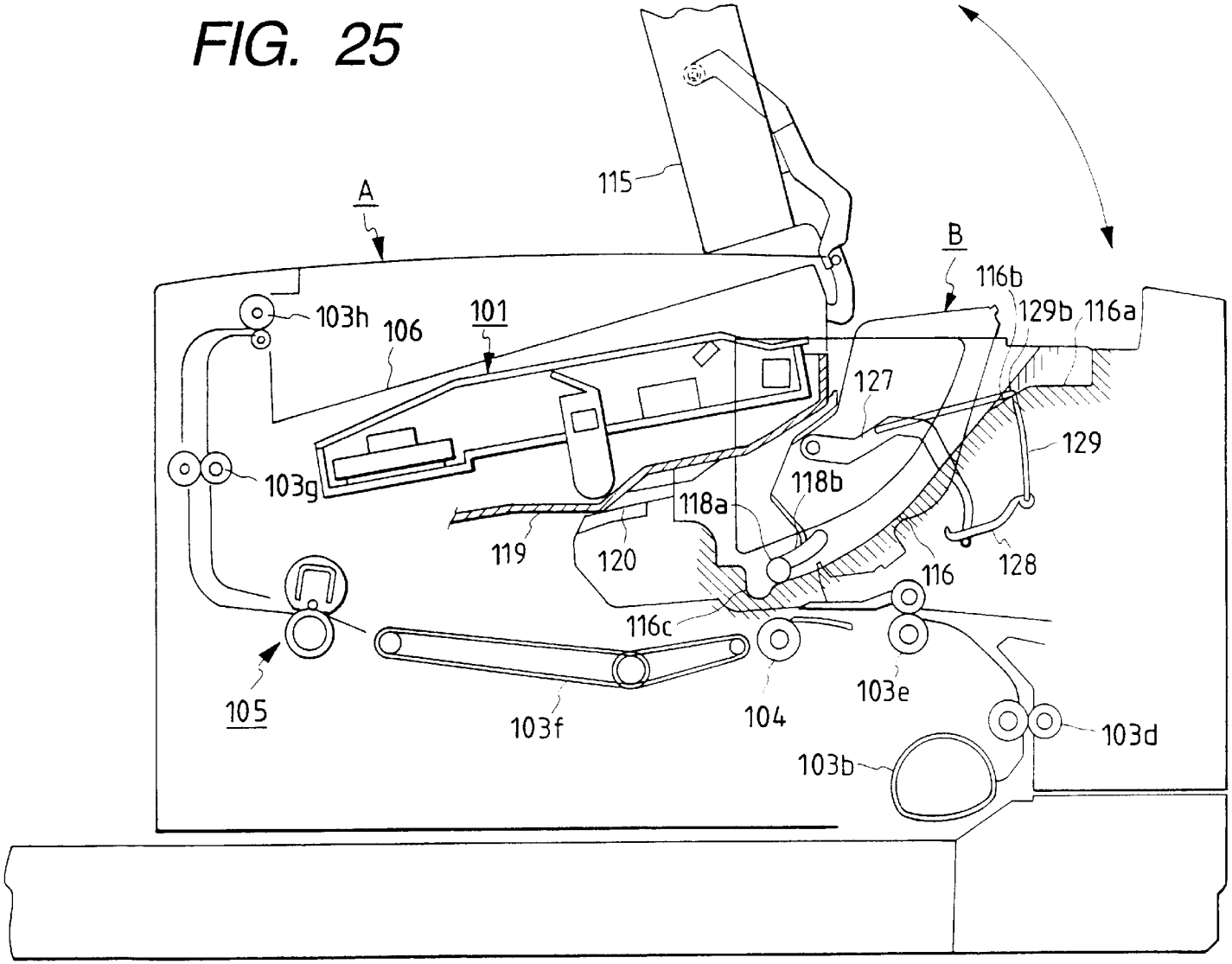
FIG. 25 is an illustration of a state in which the process cartridge is mounted on the image forming apparatus.

The mounting and dismounting of the process cartridge B are effected with an openable-closable member 115 opened as shown in FIG. 19. Cartridge mounting means is substantially symmetrically provided with a guide rail 116 formed into a curved shape (in the present embodiment, a substantially arcuate shape) forwardly depending and downwardly bulged on the left and right sides of a cartridge mounting space as shown in FIGS. 20 and 21 when the openable-closable member 115 is opened about a shaft 115*a* (see FIG. 17), and a guide member 117 is mounted above it. Further, on the entrance side of the guide rail 116, there are formed a first inclined surface 116*a* as a hook portion engaged by the contacting portion 129*b* (see FIGS. 15 and 16) of a link 129 supporting a shutter member 128 provided on the process cartridge B and a second inclined surface 116*b* subsequent to the first inclined surface 116*a,* the second inclined surface having a steeper inclination than that of the first inclined surface 116*a.*

On the other hand, corresponding to the guide rail 116, guide portions guided along the guide rail 116 are formed on the longitudinally opposite outer sides of the process cartridge B. These guide portions are formed so as to protrude from the substantially symmetrical positions of the longitudinally opposite outer sides of the cartridge frame, and as shown in FIGS. 15 and 16, are constituted by a boss 118*a* providing a first guide portion and a rib 118*b* providing a second guide portion being made integral with each other.

The boss 118*a* is located on the extension of the rotary shaft 118*f* of the photosensitive drum 107, and the rib 118*b* extends in a curved shape (in the present embodiment, a substantially arcuate shape) downwardly bulged in continuation from the boss 118*a* and in accordance with the shape of the guide rail 116 rearwardly in the direction of insertion of the process cartridge B.

Figure 26:
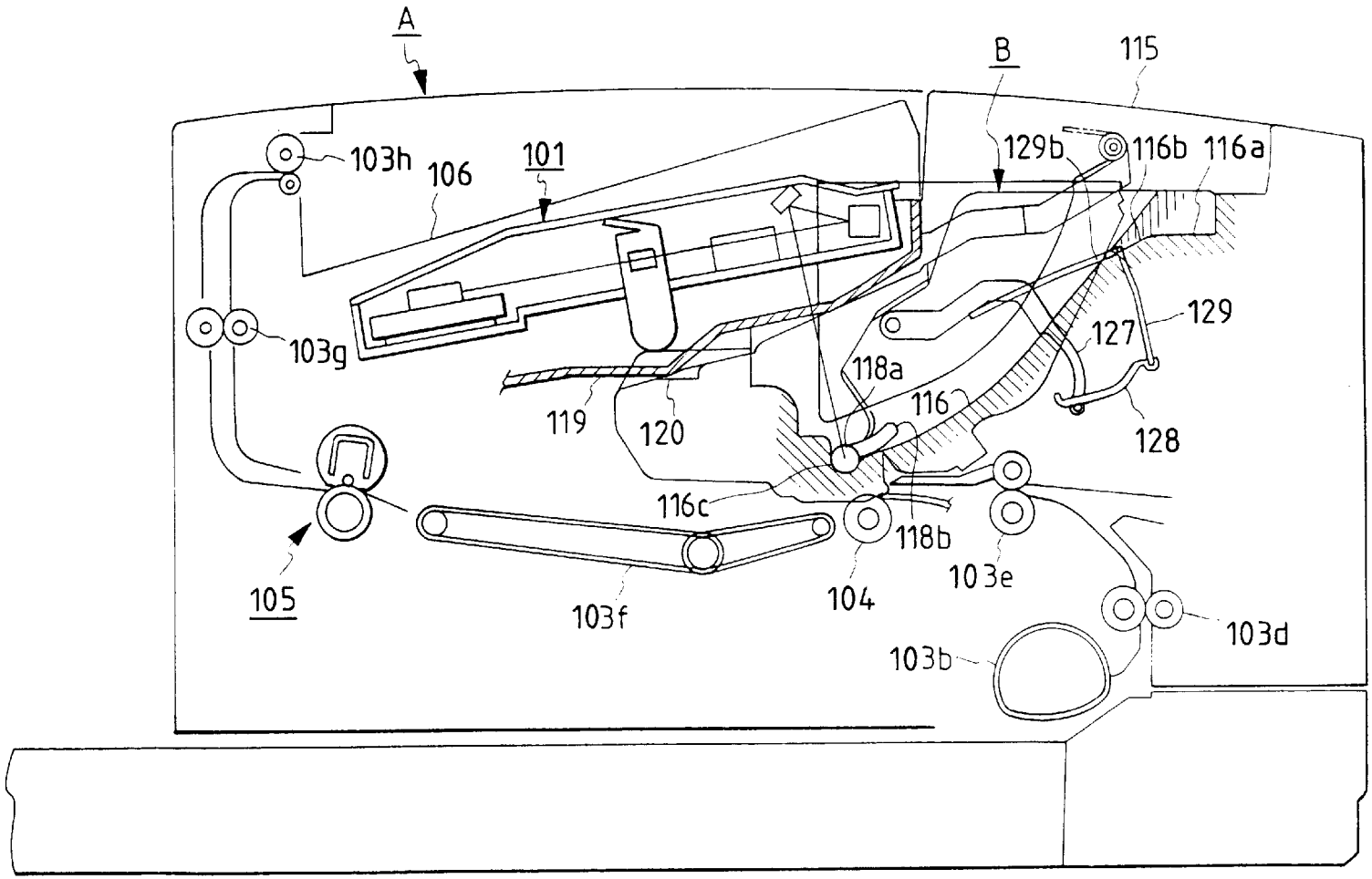
FIG. 26 is an illustration of a state in which the process cartridge is mounted on the image forming apparatus.

In the above-described construction, when the process cartridge B is to be mounted, the leading end of the process cartridge B is inserted so as to pass under the optical system 101 of the image forming apparatus A with the boss 118*a* and the rib 118*b* along the guide rails 116, as shown in FIGS. 22 to 26. The guide rail 116 is formed into a substantially arcuate shape and a guide member 117 lying above them is of a shape following them and the rib 118*b* is of a similar substantially arcuate shape and therefore, as it is inserted, the process cartridge B becomes substantially horizontal. When the process cartridge B is further pushed in, as shown in FIG. 26, an abutment member 119 (not shown) provided in the image forming apparatus A contacts a contact surface 120 provided near the opposite end portions of the leading end of the cleaning frame 113, and next, the boss 118*a* of the process cartridge B falls into a receiving concave portion 116*c* formed at the terminal end of the guide rail 116. Thereby, a drum flange 107*a* (see FIG. 30), secured to the end of the photosensitive drum 107 and having its outer periphery forming a drum gear, meshes with a driving gear 122 (see FIG. 21) on the image forming apparatus A, and becomes capable of transmitting a drive force to the process cartridge B.

Figure 27:
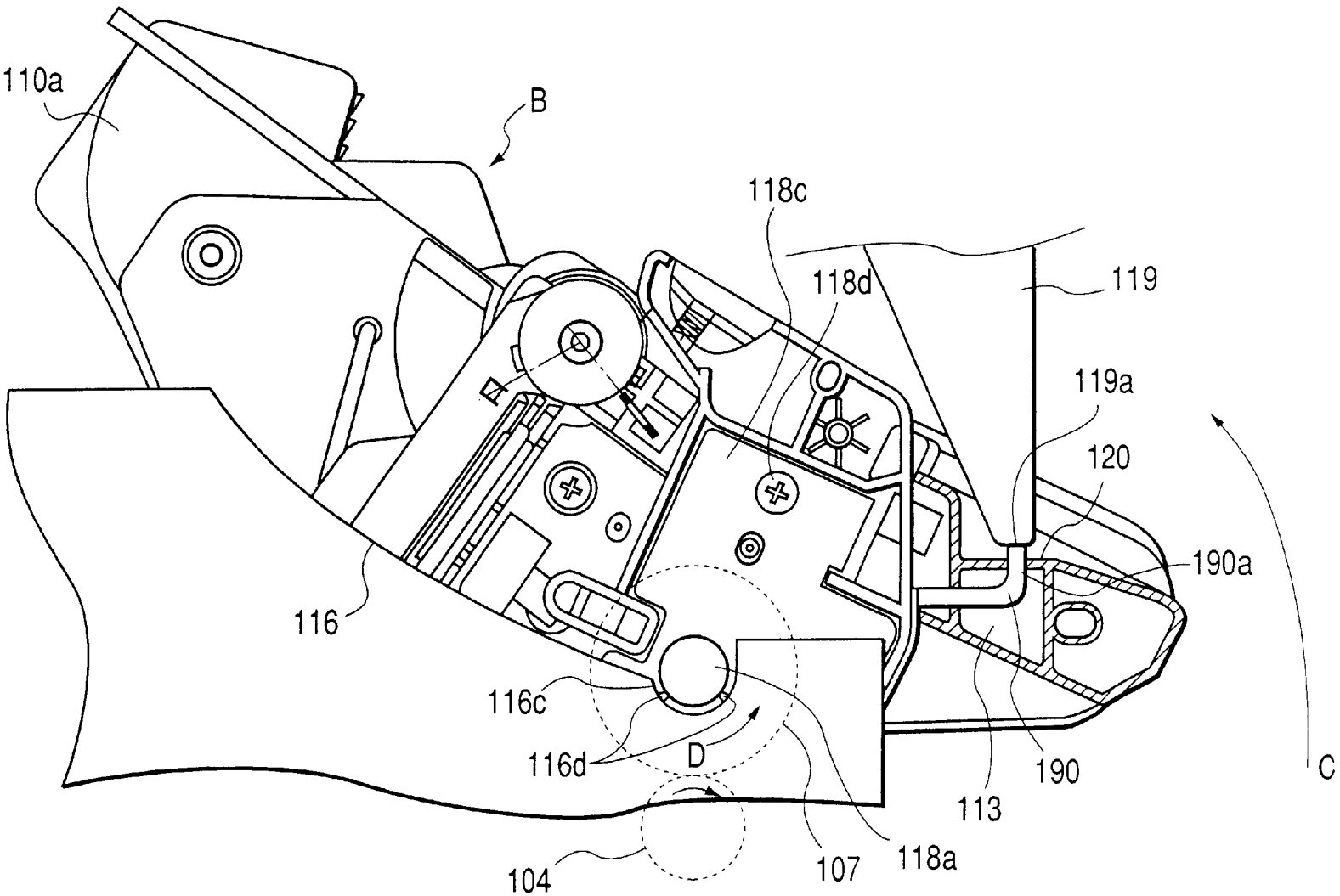
FIG. 27 is a side view illustrating Embodiments 6 and 7 of the present invention.
Figure 28:
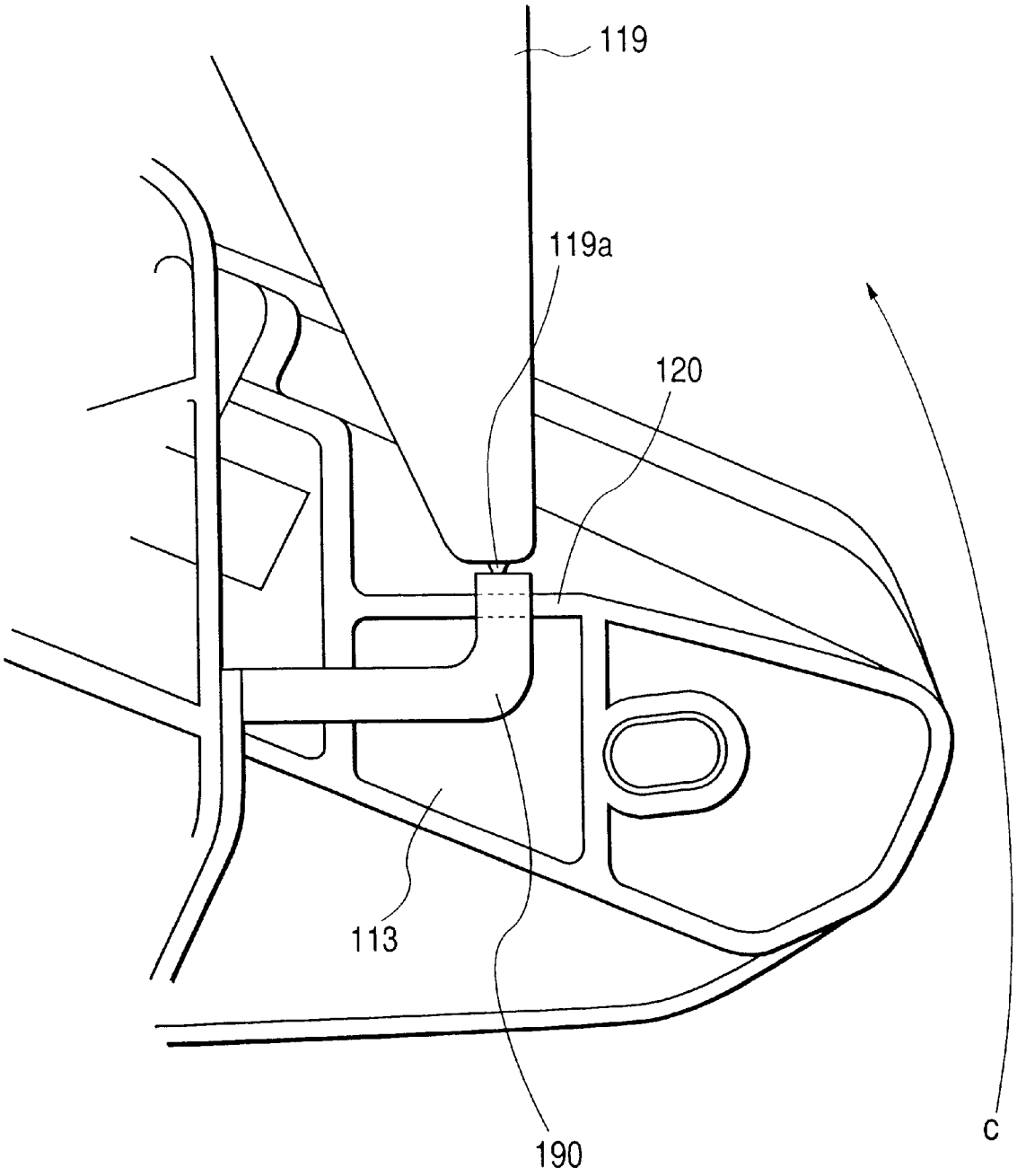
FIG. 28 is a fragmentary enlarged view of a portion of FIG. 27.
Figure 29:
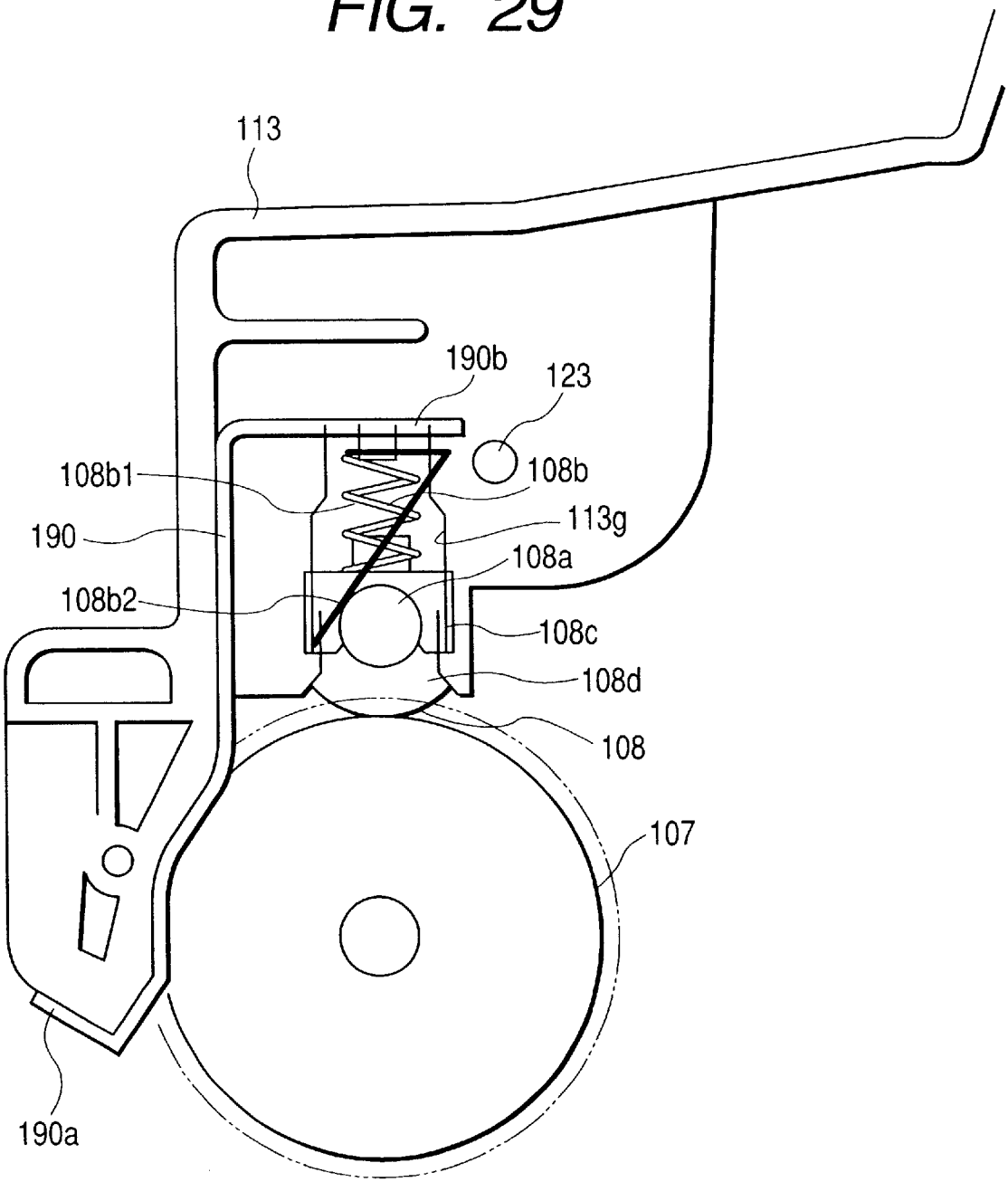
FIG. 29 is a side view illustrating an electrical route for supplying a charging bias to charging means.

Embodiment 6 of the present invention will now be described. FIG. 27 shows essential portions according to the present invention, and FIG. 28 is an enlarged view of a portion of FIG. 27. In these figures, the process cartridge B is heavier on the toner containing frame 110*a* side about the boss 118*a* and therefore, a rotational force is always working in the direction indicated by the arrow C due to self-weight. Also, when the drum flange 107*a* (see FIG. 30) meshes with the driving gear 122 (see FIG. 21) on the main body 114 of the image forming apparatus and is rotatively driven in the direction indicated by the arrow D, the process cartridge B further receives a rotational force in the direction indicated by the arrow C by the frictional force between the photosensitive drum 107 and a support member (not shown) supporting the photosensitive drum 107. Here, as previously described, the abutment member 119 provided in the image forming apparatus A contacts the contact surface 120 provided near the opposite end portions of the leading end of the cleaning frame 113, and plays the role of the so-called detent of the process cartridge B. Accordingly, the abutment member 119 and the contact surface 120 are always in pressure contact with each other by the rotational force by the aforementioned self-weight and the rotative drive received from the driving gear 122. So, if electrodes are on the abutment member 119 and the contact surface 120, the electrodes can be connected together while predetermined contact pressure is secured even without the use of a resilient member such as a spring. Here, a description will be provided of an electrode for supplying a charging voltage to the charging means taken as an example. A charging contact 190 is partly exposed and provided on the contact surface 120 of FIGS. 27, 28 and 15. The charging contact 190 is in electrical contact with the shaft 108*a* of the charging roller 108 through a composite spring 108*b*, which is spread all over the cleaning frame 113 and is in contact with the shaft 108*a* of the charging roller 108, as shown in FIG. 29. This composite spring 108*b* has an internal contact 108*b*2 urged against the shaft 108*a* of the charging roller from the spring-seat, side-end coil portion of the compression-coil spring portion 108*b*1 of the composite spring 108*b* compressedly provided between the bearing 108*c* of the charging roller slidably fitted in a guide groove 113*g* on a line substantially linking the centers of the charging roller 108 and the photosensitive drum 107 provided in the cleaning frame 113 and a spring seat 190*b* lying on one end of the guide groove 113*g*. The charging bias contact 190, as shown in FIG. 27, comes into the cleaning frame 113 from the external exposed portion 190*a* thereof and is bent across the direction of movement of the shaft 108*a* of the charging roller at one end of the charging roller 108 and terminates at the spring seat 190*b*.

On the other hand, the abutment member 119 provided in the image forming apparatus A is provided with an electrode 119*a* for supplying a charging voltage to the charging roller 108 (FIG. 28). The electrode 119*a*, receiving the supply of the charging voltage from an AC high voltage amplifying circuit, not shown, is electrically connected to the charging contact 190 by the aforementioned pressure contact, and applies the charging voltage to the charging roller 108.

The abutment member 119 and the contact surface 120 having the electrodes 119*a* and 190 are contacted by the electrodes 119*a* and 190 and provide a positioning portion and also provide a charging contact portion. Accordingly, in the abutment member 119 and the contact surface 120 having the electrodes 119*a* and 190, the positioning portion is defined independently of the positions of the abutment member 119 and the contact 120, and the abutment member 119 and the contact 120 have their positioning function hindered, and the electrodes 119*a* and 190 themselves or the support member (abutment member 119) for the electrode 119*a* provides a positioning member.

(Embodiment 7)

Figure 30:
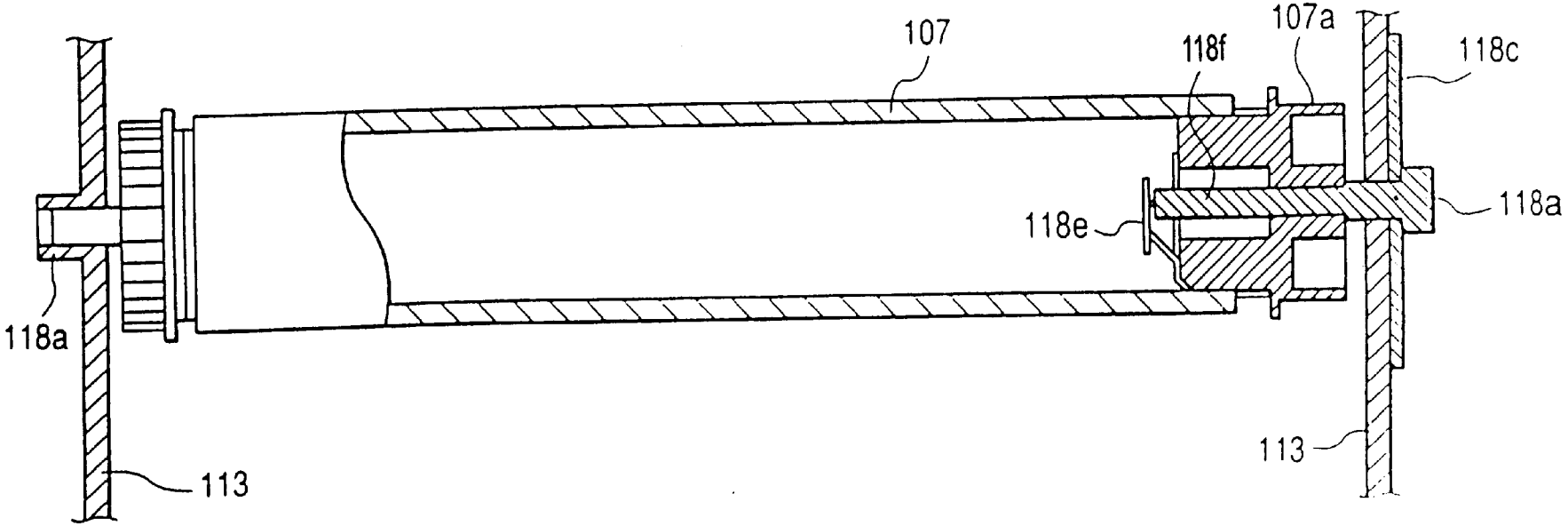
FIG. 30 is a vertical cross-sectional view illustrating the construction of a drum ground contact.
Figure 31:
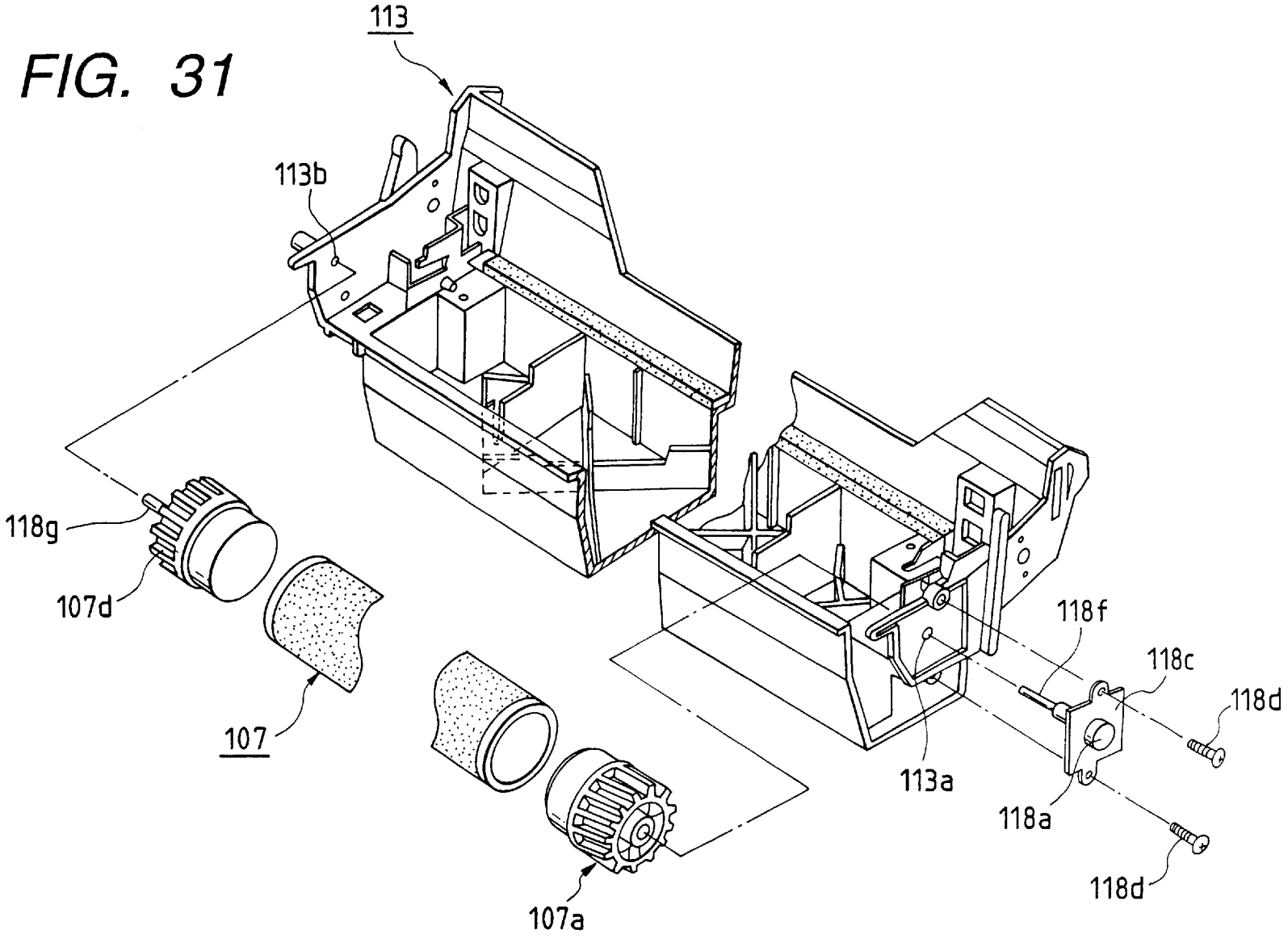
FIG. 31 is a perspective view illustrating a method of mounting the drum earth contact.

Embodiment 7 of the present invention will now be described. Embodiment 7 will be described with a case where the ground contacts of the photosensitive drum 107 are disposed on a boss 118*a* at one end of the process cartridge B in the longitudinal direction thereof and the receiving concave portion 116*c* of the image forming apparatus A taken as an example. In FIG. 27, the cylindrical boss 118*a* for supporting the process cartridge B is made of a metal or electrically conductive resin and serves also as a rotary shaft 118*f* rotatably supporting a drum flange 107*a* as shown in FIG. 30. The boss 118*a* is made integral with a supporting metal plate 118*c* as by caulking, and as shown in FIG. 31, the supporting metal plate 118*c* is attached to the cleaning frame 113 by small screws 118*d*. The rotary shaft 118*f* is fitted in an aperture 113*a* in the cleaning frame 113, and is further fitted in the central aperture in the flange 107*a* to thereby rotatably support the photosensitive drum 107. In contrast with one end of the photosensitive drum 107 supported by the rotary shaft 118*f*, a flange 107*d* is fixed to the other end of the photosensitive drum, and a rotary shaft 118*g* supported by an aperture 113*b* in the cleaning frame 113 rotatably supports the flange 107*d*. Also, as shown in FIG. 30, a drum ground plate 118*e* having a leaf spring portion on a portion thereof and made of phosphor bronze or the like is in contact with one end of the boss 118*a*. Further, the drum ground plate 118*e* is in contact with the inner peripheral surface of the photosensitive drum 107. That is, the inner peripheral surface of the photosensitive drum 107 and the drum ground plate 118*e*, and the drum ground plate 118*e* and the boss 118*a* are electrically connected together, whereby the boss 118*a* serves also as the ground contact of the photosensitive drum 107.

As shown in FIG. 27, the drum ground contact 116*d* of the image forming apparatus A is provided in the receiving concave portion 116*c* of the image forming apparatus A. This drum ground contact 116*d* is in contact with the peripheral surface of the boss 118*a* and underlies the boss 118*a* so as to bear the process cartridge B. Two such drum ground contacts 116*d* are provided in the concave portion 116*c* to make the stability of the boss 118*a* good. The boss 118*a* is in pressure contact with the drum ground contact 116*d* of the image forming apparatus A by the self-weight of the process cartridge B and therefore, a predetermined pressure force can be obtained even if a resilient member, such as a spring, is not used.

While in the above-described Embodiment 6, there has been shown an embodiment in which a charging contact is disposed on the contact surface 120 of the process cartridge B and in Embodiment 7, there has been shown an embodiment in which the ground contacts of the photosensitive drum 107 are disposed on the boss 118*a,* those contacts are not restrictive, but any contact electrically connecting the process cartridge B and the image forming apparatus A together, such as a charging contact, the ground contact of the photosensitive drum or a developing bias contact for supplying a developing voltage may be used.

Also, in Embodiment 7, there has been shown an example in which one boss 118*a* of the process cartridge B is used as a contact, but if a similar contact is disposed on the other boss (not shown) and contacts are disposed on both bosses, a further reduction in cost will become possible. Of course, Embodiment 6 and Embodiment 7 may be utilized singly or both of them may be utilized at a time.

The above-described Embodiments 6 and 7, as described with respect also to the process cartridge, are also applied to a developer cartridge in which developing means such as a developing roller and a toner containing portion containing therein a toner to be supplied to the developing roller are made into an integral cartridge detachably mountable on the main body of an image forming apparatus, and an electrophotographic image forming apparatus on which the developer cartridge is detachably mountable and which forms an image on a recording medium, and again in this case, each of the positioning portion of the developer cartridge and the positioning portion of the main body of the image forming apparatus, which corresponds to the positioning portion of the developer cartridge, has an electrode, and when the developer cartridge is mounted on the main body of the image forming apparatus, the two electrodes are connected together, and a developing bias is applied from a developing bias power source provided in the main body of the image forming apparatus to the developing roller through the two electrodes. Also, a detecting device for detecting the presence or absence of developing means in Embodiment 10, which will be described later, is provided in the main body of the image forming apparatus.

Embodiments 8, 9 and 10 of the present invention will now be described in the named order. These Embodiments 8, 9 and 10 are means for detecting the presence or absence of the process cartridge by the utilization of an electric circuit comprising the electrical contact construction of the image forming apparatus and the process cartridge according to the present invention described in Embodiments 6 and 7.

(Embodiment 8)

In Embodiment 8, a description will first be provided of an embodiment for detecting the presence or absence of the process cartridge by the use of a circuit for supplying a charging bias to the charging means shown in Embodiment 6.

Figure 32:
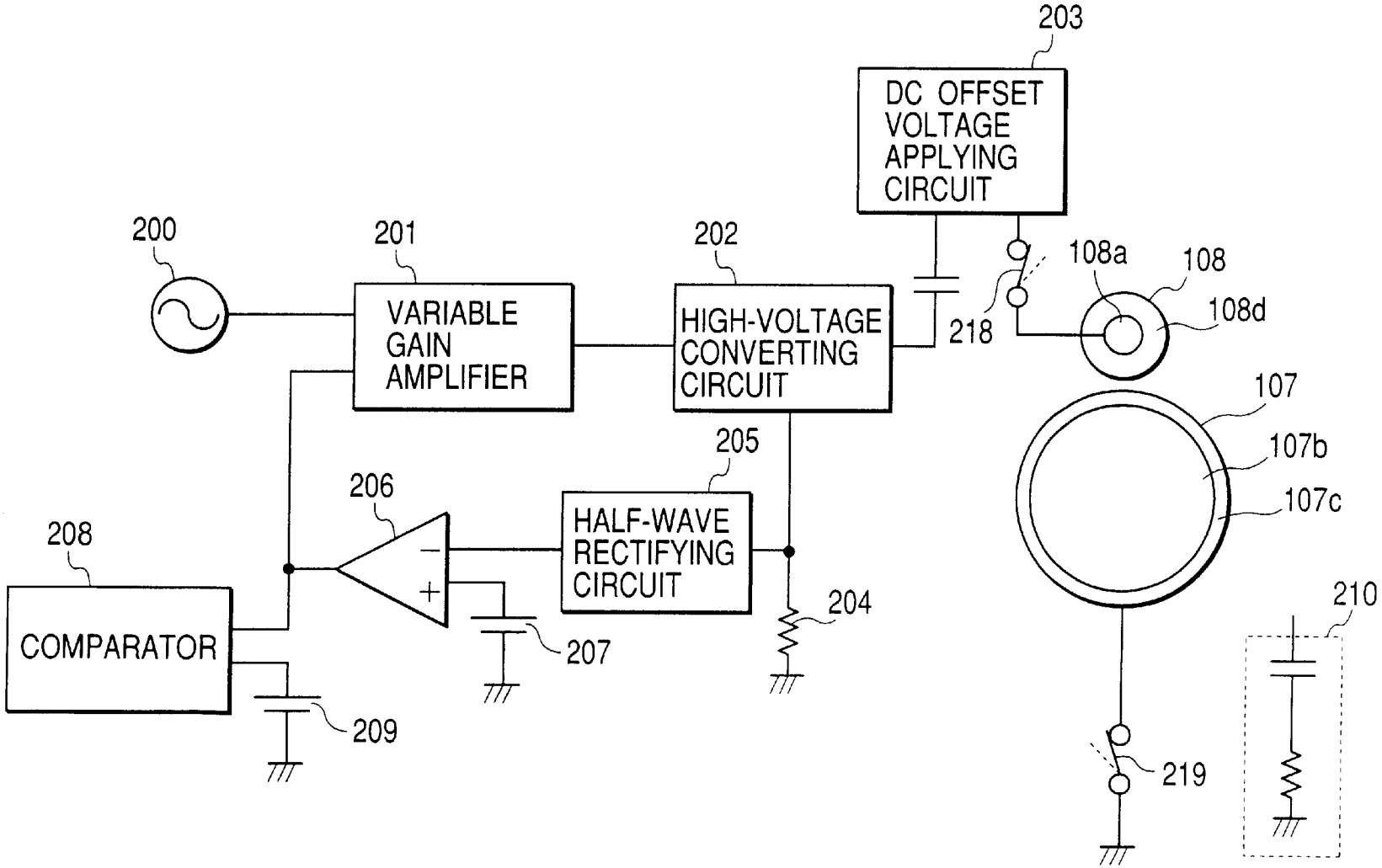
FIG. 32 is a block diagram illustrating Embodiment 8 of the present invention.
Figure 33:
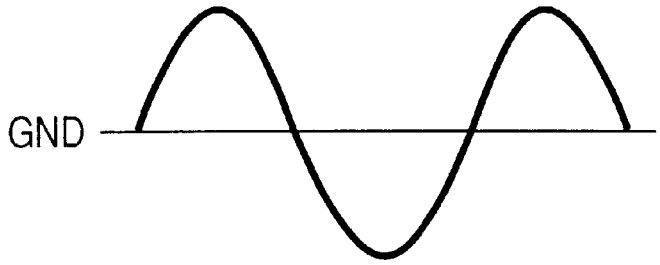
FIG. 33 is an operation waveform graph illustrating the operation of Embodiment 8 of the present invention.

FIG. 32 is a block diagram showing a detecting device provided in Embodiment 8 of the present invention, which is capable of detecting the presence or absence of the process cartridge B or the charging means. In this Embodiment 8, a charging roller 108 using an electrically conductive resistor is used as the charging means, and the detecting device in the present embodiment is a detecting device for the charging means in the process cartridge B in an electrophotographic apparatus using the charging roller 108.

In FIG. 32, the reference numeral 200 designates a reference-voltage generating device generating an AC voltage of a predetermined period. The reference numeral 201 denotes a variable gain amplifier, which is a variable amplification oscillator whose gain is varied by the fed-back output voltage of an error amplifier, which will be described later. The reference numeral 202 designates a high-voltage converting circuit as an AC high-voltage amplifying circuit for converting an AC voltage received from the variable gain amplifier 201 into an AC high voltage. The reference numeral 203 denotes a DC offset voltage applying circuit of a constant voltage.

Figure 34:
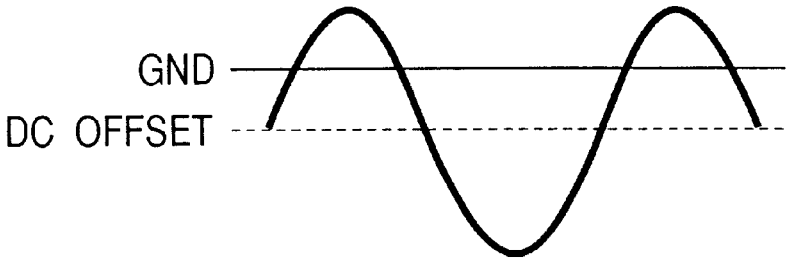
FIG. 34 is an operation waveform graph illustrating the operation of Embodiment 8 of the present invention.

The reference numeral 108 designates the charging roller to which is applied a voltage waveform as shown in FIG. 34, wherein the high-voltage converting circuit 202 and the DC offset voltage applying circuit 203 are superposed one upon the other. The charging roller 108 is formed by a charging roller shaft 108*a* and a sponge-like resistor 108*d.* The reference numeral 107 denotes a photosensitive drum formed by a photosensitive member 107*c* with the conductor portion 107*b* of a drum made of aluminum.

Figure 35:
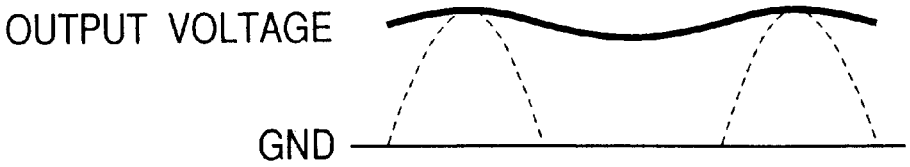
FIG. 35 is an operation waveform graph illustrating the operation of Embodiment 8 of the present invention.

An AC current detecting circuit comprises a current rectifying resistor 204 for detecting the current flowing through the high-voltage converting circuit 202 as a voltage value. The reference numeral 205 denotes a half-wave rectifying circuit for rectifying an inputted AC voltage as shown in FIG. 35, and outputting a peak value or an effective value. The reference numeral 206 designates an error amplifier having the differential voltage amplifying function, and it outputs the difference between the output of the half-wave rectifying circuit 205 and a first reference voltage outputted from a reference voltage generator 207. The current rectifying resistor 204, the half-wave rectifying circuit 205, the first reference voltage 207 and the error amplifier 206 together constitute an AC current detecting circuit.

The reference numeral 208 denotes a comparator, which is a circuit for comparing the output voltage of the error amplifier 206 and a second reference voltage outputted from a reference voltage generator 209 with each other, and is a device for determining the presence or absence of the process cartridge B or the charging means based on the result of the comparison. The reference numeral 210 designates the equivalent circuit of the charging roller 108 and the photosensitive drum 107, and the impedance thereof is determined by such parameters as the resistance value of the sponge-like resistor 108*d* and the thickness of the photosensitive member 107*c.* The reference numeral 218 denotes the aforementioned charging contact 119*a,* and the reference numeral 219 designates the aforementioned drum ground contact. The impedance of the equivalent circuit 210 becomes infinity when the process cartridge B or the charging means is absent or when the process cartridge B is not completely mounted and the charging contact 218 or the drum ground contact 219 is not connected.

A description will hereinafter be provided of the process of detecting the presence or absence of the process cartridge B or the charger in the thus constructed apparatus.

As described above, a voltage waveform as shown in FIG. 34, which comprises a predetermined DC offset voltage and an AC voltage of a predetermined period superimposed one upon the other, is applied to the charging roller 108. The voltage amplitude of the AC component of this waveform is determined as will be described below.

The half-wave rectifying circuit 205 detects the output current of the high-voltage converting circuit 202, and outputs the detected output to the error amplifier 206. The error amplifier 206 amplifies the difference between the output value of the half-wave rectifying circuit 205 and the first reference voltage (207), and outputs the output thereof to the variable gain amplifier 201. The variable gain amplifier 201 outputs an AC voltage of the period of the AC reference voltage (200) and an amplitude proportional to the output of the error amplifier 206. The high-voltage converting circuit 202 outputs an AC high voltage proportional to the AC voltage outputted from the variable gain amplifier 201. A negative feedback loop is established by the route of the variable gain amplifier 201, the high-voltage converting circuit 202, the current rectifying resistor 204, the half-wave rectifying circuit 205 and the error amplifier 206, and as the result, it acts so that the output voltage of the half-wave rectifying circuit 205 and the first reference voltage (207) may coincide with each other. The output of the half-wave rectifying circuit 205 detects the output current of the high-voltage converting circuit 202 and therefore, the AC output current of the high-voltage converting circuit 202 becomes a constant current.

As described above, the amplitude of the AC voltage applied to the charging roller 108 is controlled so that the current flowing to the impedance represented by the equivalent circuit 210 may become constant.

As described above, a waveform comprising the DC offset of a constant voltage and the AC high voltage of a constant current superimposed one upon the other is applied to the charging roller 108. It is a known technique to apply such a waveform to the charging roller 108, and it is useful to cause uniform charges to be charged on the surface of the photosensitive member 107*c*.

The output of the error amplifier 206 and the amplitude of the AC voltage outputted by the high-voltage converting circuit 202 are in a proportional relation and therefore, by detecting the output of the error amplifier 206, it is possible to detect the amplitude of the AC high voltage applied to the charging roller 108.

When the process cartridge B or the charging means is absent or when the process cartridge B is not completely mounted, the charging contact 218 and the drum ground contact 219 are not connected together and therefore, the impedance of the equivalent circuit 210 becomes infinity. The maximum voltage that the high-voltage converting circuit 202 can output is restricted to a predetermined value and therefore, at this time, a primary AC current scarcely flows. Therefore, the output voltage of the half-wave rectifying circuit 205 becomes nearly 0. Therefore, the output of the error amplifier 206 becomes high up to a maximum value that can be outputted and is saturated.

The impedance of the equivalent circuit 210 is varied by the irregularity of the resistance value of the sponge-like resistor 108*d*, the thickness of the photosensitive member, etc. The output voltage of the second reference voltage generator 209 is set so as to become higher than the voltage outputted by the error amplifier 206 when the impedance thereof becomes maximum.

Accordingly, when the process cartridge B or the charging means is absent or when the process cartridge B is not completely mounted, the impedance of the equivalent circuit 210 becomes infinity and therefore, the output voltage of the error amplifier 206 becomes higher than the output of the reference voltage 209, and the output of the comparator 208 is reversed.

By the output of the comparator 208 being detected by the above-described construction and action, the presence or absence of the process cartridge or the charging means can be detected. Also, the circuits other than the comparator 208 are circuits that are, of course, required as the charging means and therefore, the increase in cost can be compensated for by the comparator alone.

(Embodiment 9)

Figure 36:
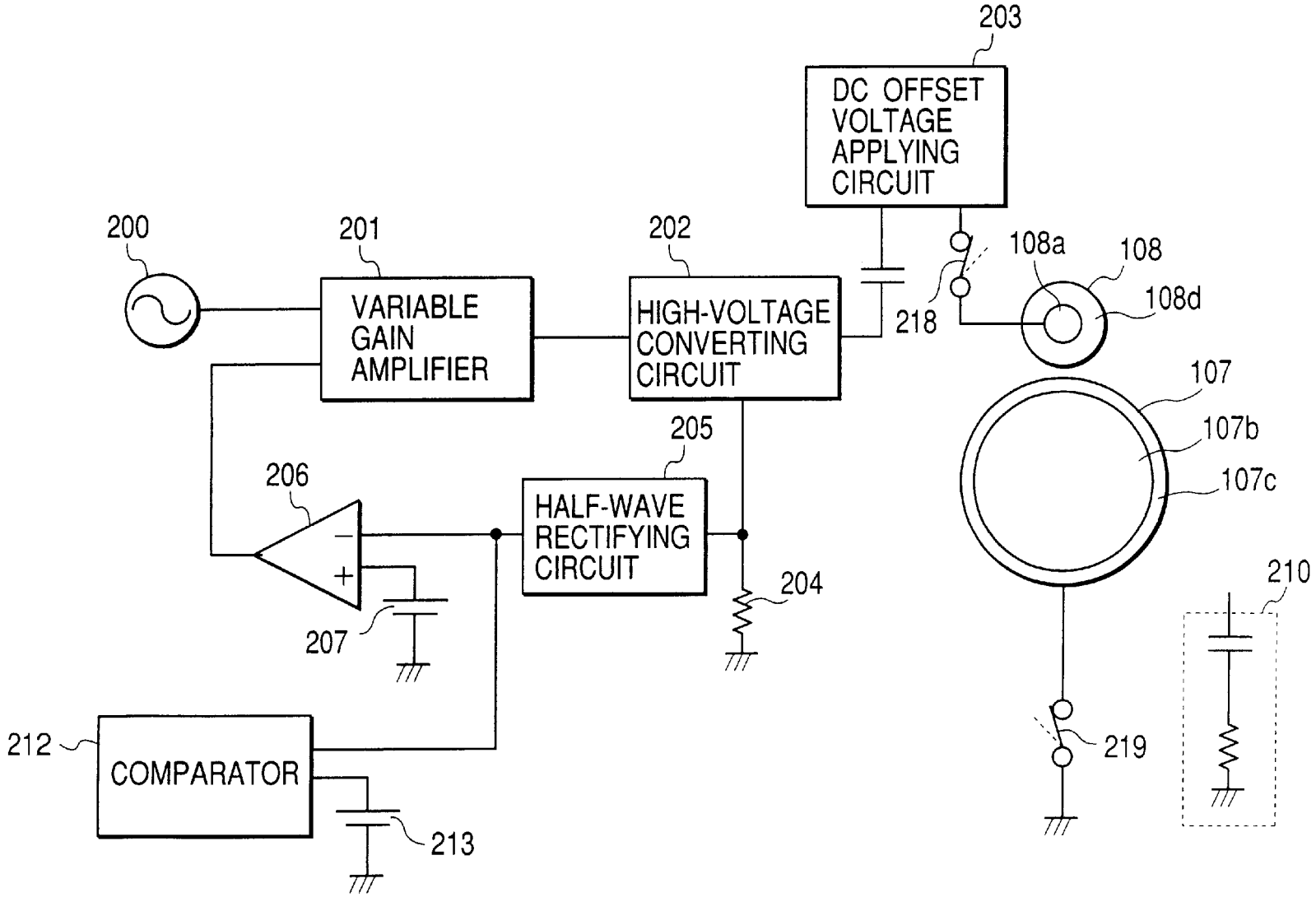
FIG. 36 is a block diagram illustrating Embodiment 9 of the present invention.

FIG. 36 is a block diagram of a detecting device provided in Embodiment 9 of the present invention. The other circuit constructions and operations than the reference numeral 212 are similar to those in the aforedescribed Embodiment 8 and therefore the description thereof is invoked.

The reference numeral 212 designates a comparator or a circuit for comparing the output of the half-wave rectifying circuit 205 and the output voltage of a reference voltage generator 213 with each other, and as the result of this comparison, the presence or absence of the process cartridge B or the charging means is detected.

As described in Embodiment 8, the AC current flowing through the equivalent circuit 210 is in a proportional relation with the output voltage of the half-wave rectifying circuit 205 and therefore, by detecting the output value thereof, the current value flowing through the equivalent circuit 210 can be detected.

When the process cartridge B or the charging means is not completely mounted, the impedance of the equivalent circuit 210 is infinity and therefore, the current flowing through the equivalent circuit 210 is almost 0. Therefore, the output value of the half-wave rectifying circuit 205 becomes remarkably lower than when the process cartridge B or the charging means is present.

The output voltage of the reference voltage generator 213 is set so as to become the output voltage of the half-wave rectifying circuit 205 when the impedance of the equivalent circuit becomes maximum because of the presence of the process cartridge B or the charging means, that is, when the current flowing through the equivalent circuit 210 becomes minimum. Accordingly, when the process cartridge B is present, the output voltage of the half-wave rectifying circuit 205 reaches the output voltage of the reference voltage generator 213, but when the process cartridge B is absent, the impedance of the equivalent circuit 210 becomes infinity and therefore, the output voltage of the half-wave rectifying circuit 205 does not reach the output voltage of the reference voltage generator 213 and therefore, the output of a comparator 212 is reversed.

By the output of the comparator 212 being detected by the above-described construction and action, the presence or absence of the process cartridge B or the charging means can be detected.

(Embodiment 10)

Figure 37:
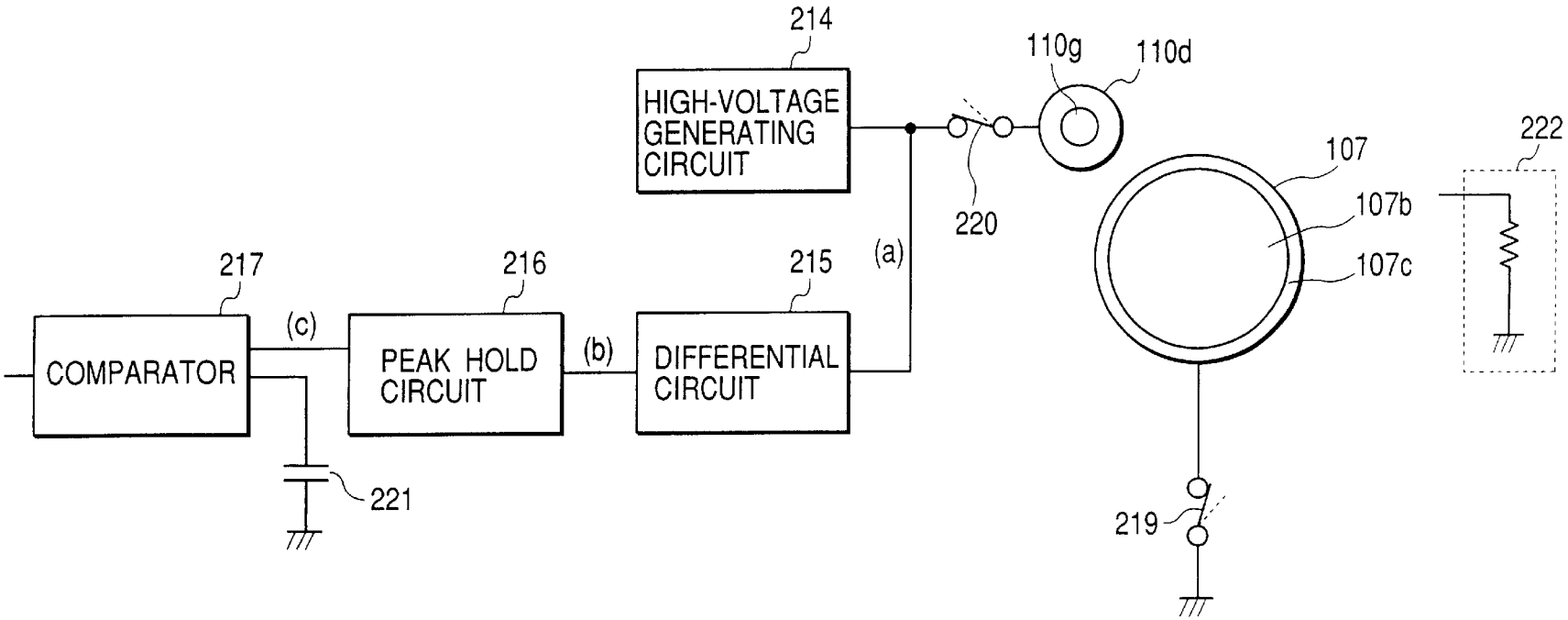
FIG. 37 is a block diagram illustrating Embodiment 10 of the present invention.

FIG. 37 is a block diagram of a detecting device capable of detecting the presence or absence of a process cartridge B or developing means provided in Embodiment 10 of the present invention.

In the present embodiment, use is made of a developing method (so-called jumping developing method) of applying to the developing roller 110*d* a voltage comprising a DC offset voltage and a rectangular wave voltage superimposed one upon the other, and causing the toner adhering to the developing roller 110*d* to jump to the photosensitive drum 107 opposed to the developing roller 110*d*. The detecting device provided in Embodiment 10 is a detecting device for detecting the presence or absence of a toner cartridge or developing means using the jumping developing method. The reference numeral 220 designates a developing contact for applying a developing voltage to the developing roller. The reference numeral 219 denotes a drum ground contact for grounding the photosensitive drum 107.

Figure 38A:
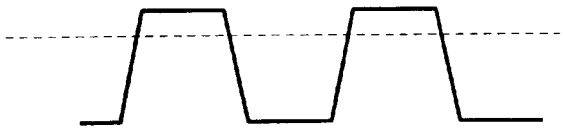
FIGS. 38A, 38B and 38C are operation waveform graphs illustrating the operation of Embodiment 10 of the present invention.

In FIG. 37, the reference numeral 107 designates a photosensitive drum, and on the surface thereof, an image of charges, i.e., a so-called latent image, is formed by an exposure device and a charging device, not shown. The reference character 110*d* denotes a developing roller opposed to the photosensitive drum 107, and it contains a bar-like magnet 110*g* therein. By the magnetic force of the bar-like magnet 110*g*, the charged toner adheres to the surface of the developing roller 110*d*. The reference numeral 214 designates a high-voltage generating circuit that outputs a voltage as shown in FIG. 38A comprising a DC offset voltage and a rectangular wave voltage superimposed one upon the other, and applies the voltage waveform thereof to the developing roller 110*d*. The toner adhering to the surface of the developing roller 110*d* by the voltage waveform outputted by the high-voltage generating circuit 214 jumps to the surface of the photosensitive drum 107 being rotated, and as the result, the latent image is converted into a toner image. This developing process is so-called jumping development, which is a known technique.

Figure 38B:
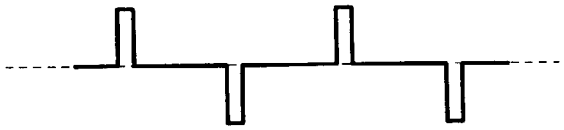
Figure 38C:
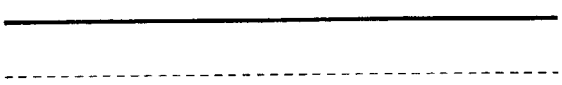
Figure 39:
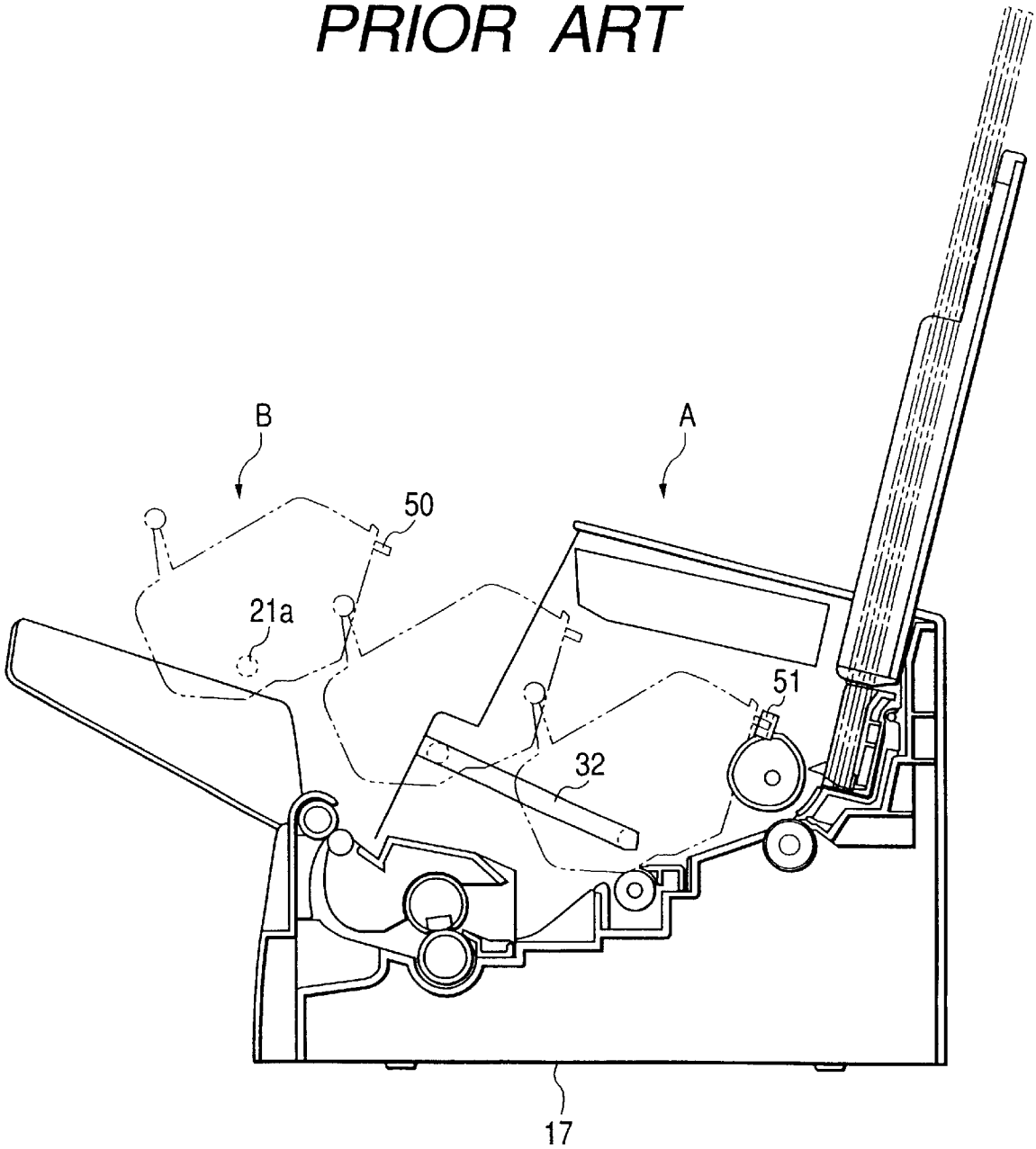
FIG. 39 PRIOR ART
FIG. 39 is a side view showing the conventional art.

In FIG. 37, the reference numerals 215, 216, 217 and 221 designate circuits provided to detect the presence or absence of the process cartridge or the developing means. The circuit 215 is a differential circuit that outputs the differential waveform of a voltage waveform outputted from the high-voltage generating circuit 214, and outputs a rectangular waveform or an AC waveform (sine wave) as shown in FIG. 38B. The circuit 216 is a peak hold circuit that holds the maximum value of the differential waveform outputted from the differential circuit 215 for a predetermined period. By the differential circuit 215, the differential waveform is converted into a DC voltage as shown in FIG. 38C. The circuit 217 is a comparator that compares the voltage outputted from the peak hold circuit 236 and the voltage outputted from the reference voltage generator 221 with each other, and converts the result into a high or low logic level.

The operation of the detecting device constituted by the differential circuit 215, the peak hold circuit 216, the comparator 217 and the reference voltage generator 221 will now be described in detail.

The reference numeral 222 denotes an equivalent circuit electrically representing a load constituted by the developing roller 110*d* and the photosensitive drum 107, and it is represented by the series resistance of a resistor and a capacitor. The narrower the gap between the developing roller 110*d* and the photosensitive drum 107 becomes, the greater becomes the capacity value of the capacitor. When the developing roller 110*d* is absent or when the process cartridge B including the developing roller 110*d* and the photosensitive drum 107 is absent, the capacity value of the capacitor of the equivalent circuit 222 becomes small and the impedance thereof approximates to infinity. As a matter of course, the output impedance of the high-voltage generating circuit 214 does not become zero and therefore, in such a no-load state, the rising time of the output waveform of the high-voltage generating circuit 214 becomes very short. At this time, the peak value of the output of the differential circuit 215 becomes high and the output voltage of the peak hold circuit 216 becomes high. If the output voltage value of the peak hold circuit 216 in the no-load state is preset so as to become somewhat higher than the output voltage value of the reference voltage generator 221, the output of the comparator 217 will be reversed by a change in the load and no-load states.

As described above, the output of the comparator 217 is reversed by the presence or absence of the developing roller 110*d* or the presence or absence of the process cartridge including the developing roller 110*d* and the photosensitive drum 107 and therefore, by monitoring the output of the comparator 217, it is possible to detect the presence or absence of the developer cartridge or the process cartridge.

This Embodiment 10 may be applied to an electrophotographic image forming apparatus to which a developer cartridge having developing means such as a developing roller is detachably mountable.

As described above, according to the aforedescribed embodiments, the electrical contacts of the main body of the image forming apparatus and the process cartridge can be brought into contact with each other with a predetermined pressure force even if a resilient member is not used and therefore, the number of parts can be curtailed and a reduction in cost becomes possible.

Also, according to the afore described embodiments, the outer periphery of the electrically conductive boss conducting to the electrophotographic photosensitive drum is used as the positioning portion and therefore, the positioning portion and the electrode for ground are obtained without a member for taking drum ground being discretely provided.

Also, according to the aforedescribed embodiments, the positioning portion for determining the posture of the process cartridge is the electrode of the process means and therefore, the connection of the electrode is done simultaneously with positioning.

Also, according to the aforedescribed embodiments, the electrode conducts to the charging means and therefore, the connection of the electrode is reliably done simultaneously with positioning.

Also, according to the aforedescribed embodiments, the electrode for applying the developing bias is pressed and connected in the positioning portion as soon as the developer cartridge is positioned.

Also, according to the aforedescribed embodiments, in an electrophotographic image forming apparatus to which a process cartridge is detachably mountable, the electrode for applying a high voltage current to the process means is pressed simultaneously with the positioning of the process cartridge and is connected in the positioning portion and therefore, it becomes unnecessary to press the electrical contact by the use of a resilient member and thus, the number of parts can be curtailed and a reduction in cost becomes possible. Also, the electrode is immovable and therefore, the installation space for the electrode when the electrode is movable is dispensable.

Also, according to the aforedescribed embodiments, in an electrophotographic image forming apparatus to which a developer cartridge is detachably mountable, the electrode for applying the developing bias to the developing roller is pressed simultaneously with the positioning of the developer cartridge and is connected in the positioning portion and therefore, it becomes unnecessary to press the electrical contact by the use of a resilient member and thus, the number of parts can be curtailed and a reduction in cost becomes possible. Also, the electrode is immovable and therefore, the installation space for the electrode when the electrode is movable is dispensable.

Also, according to the afore described embodiments, the presence or absence of the process cartridge or the developer cartridge is detected by the use of an electric circuit comprised of electrical contacts and therefore, the wrong detection of detecting the process cartridge or the developer cartridge in the so-called incompletely mounted state when the process cartridge or the developer cartridge has been mounted in the course of the stroke, which is the flexure allowance of the resilient member described in connection with the conventional art, can be avoided. In other words, the electrical contacts are of a contact construction free of the stroke, which is the flexure allowance of the resilient member described in connection with the conventional art, and therefore, the aforementioned so-called incomplete mounting can be avoided and even if the incomplete mounting when a slight gap is formed between the contacts happens, the contacts are not connected together and the user can be informed of it by the means for detecting the presence or absence of the process cartridge or the developer cartridge.

As described above, according to the present invention, it can be accurately detected that the process cartridge or/and the developer cartridge have been mounted on the main body of the apparatus.

While the invention has been described with respect to the structures disclosed herein, it is not confined to the details set forth and this application is intended to cover such modifications or changes as may come within the purposes of the improvements or the scope of the following claims.

What is claimed is:

1. An electrophotographic image forming apparatus to which a process cartridge is detachably mountable for forming an image on a recording medium, comprising:

(a) mounting means for detachably mounting the process cartridge, the process cartridge including:

an electrophotographic photosensitive drum, process means acting on said electrophotographic photosensitive drum, a supported portion of the cartridge to be supported by a supporting portion of a main body of the image forming apparatus when the process cartridge is mounted to the main body of the image forming apparatus, and a detecting action portion provided on said supported portion of the cartridge and for operating cartridge detecting means for detecting a mounting of the process cartridge to the main body of the image forming apparatus when the process cartridge has been mounted at a mounting position in the main body of the image forming apparatus;

(b) said cartridge detecting means for detecting the mounting of the process cartridge; and (c) conveying means for conveying said recording medium.

2. An electrophotographic image forming apparatus according to claim 1, wherein an actuator of said cartridge detecting means is displaced substantially in a same direction as a mounting direction of the process cartridge, whereby the cartridge detecting means is operated.

3. An electrophotographic image forming apparatus according to claim 1, wherein an actuator of said cartridge detecting means is displaced in a direction intersecting a mounting direction of the process cartridge, whereby the cartridge detecting means is operated.

4. An electrophotographic image forming apparatus according to any one of claims 1 to 3, wherein an actuator of said cartridge detecting means conducts to a high voltage circuit or a process cartridge presence or absence detecting circuit of the main body of the image forming apparatus or is grounded.

5. An electrophotographic image forming apparatus according to claim 4, wherein said cartridge detecting means is provided on each of a left and a right sides as viewed from a mounting direction of the process cartridge, and the cartridge detecting means on one side leads to the high voltage circuit and leads to the process cartridge presence or absence detecting circuit, and the cartridge detecting means on the other side is grounded.

6. An electrophotographic image forming apparatus to which a process cartridge is detachably mountable for forming an image on a recording medium, comprising:

(a) a process cartridge mounting portion for detachably mounting the process cartridge, the process cartridge including:

an electrophotographic photosensitive member, process means acting on said electrophotographic photosensitive member, and a positioning portion of the cartridge having an electrode to be connected to an electrode provided on a positioning portion of the process cartridge mounting portion on a main body of said image forming apparatus and for supplying an electric current from the main body of said image forming apparatus to said process means or for grounding said electrophotographic photosensitive member;

(b) the positioning portion having the electrode provided on said process cartridge mounting portion and to be connected to the electrode of said positioning portion of the cartridge;

(c) a high voltage source generating a high-voltage current to be supplied to the electrode connected to the electrode of said positioning portion of the cartridge or a grounding member for grounding the electrode connected to the electrode of said positioning portion of the cartridge; and (d) conveying means for conveying said recording medium.

7. An electrophotographic image forming apparatus according to claim 6, wherein one of the process means provided in said process cartridge is charging means for charging the electrophotographic photosensitive member, and the electrodes provided on the positioning portion on the main body of said image forming apparatus and the positioning portion of said process cartridge are electrodes for supplying a high-voltage AC to said charging means, and said image forming apparatus further comprises an AC high-voltage amplifying circuit for supplying a high-voltage AC to said charging means, an AC current detecting circuit for detecting the AC current outputted from said AC high-voltage amplifying circuit, a difference voltage amplifier for amplifying a difference voltage between an output voltage of said AC current detecting circuit and a first reference voltage, a variable amplitude oscillator of which a waveform amplitude of the AC output voltage is varied correspondingly to an output voltage of said difference voltage amplifier and is inputted to said AC high-voltage amplifying circuit, a comparator for comparing the output voltage of said AC current detecting circuit with a second reference voltage, and mounting detecting means for detecting a presence or absence of the process cartridge by use of said comparator.

8. An electrophotographic image forming apparatus according to claim 6, wherein one of the process means provided in said process cartridge is developing means for developing a latent image formed on the electrophotographic photosensitive member by use of a toner, and the electrodes provided on the positioning portion on the main body of said image forming apparatus and the positioning portion of said process cartridge are electrodes for supplying an AC or rectangular wave high voltage to said developing means, and said image forming apparatus further comprises a high-voltage generating circuit for supplying an AC or rectangular wave high voltage to said developing means, a voltage differential circuit connected to an output from said high-voltage generating circuit, a peak hold circuit connected to an output of said voltage differential circuit, a comparator for comparing an output voltage of said peak hold circuit with a reference voltage, and mounting detecting means for detecting a presence or absence of said process cartridge by said comparator.

9. An electrophotographic image forming apparatus to which a developer cartridge is detachably mountable for forming an image on a recording medium, comprising:

(a) a developer cartridge mounting portion for detachably mounting the developer cartridge, the developer cartridge including:

a developing roller, a toner containing portion containing therein a toner to be supplied to said developing roller, and a positioning portion of the cartridge having an electrode to be connected to an electrode provided on a positioning portion of the developer cartridge mounting portion on a main body of said image forming apparatus and for applying a developing bias from the main body of the image forming apparatus to said developing roller;

(b) the positioning portion having the electrode provided on said developer cartridge mounting portion and to be connected to the electrode of said positioning portion of the cartridge;

(c) a developing bias power source for supplying a developing bias to the electrode connected to said electrode of the cartridge; and (d) conveying means for conveying said recording medium.

10. An electrophotographic image forming apparatus according to claim 9, further comprising an electrophotographic photosensitive member, and wherein the developing roller provided in said developer cartridge is developing means for developing a latent image formed on the electrophotographic photosensitive member by use of a toner, and the electrodes provided on the positioning portion on the main body of said image forming apparatus and the positioning portion of said developer cartridge are electrodes for supplying an AC or rectangular wave high voltage to said developing means, and said image forming apparatus further comprises a high-voltage generating circuit for supplying an AC or rectangular wave high voltage to said developing means, a voltage differential circuit connected to an output from said high-voltage generating circuit, a peak hold circuit connected to an output of said voltage differential circuit, a comparator for comparing an output voltage of said peak hold circuit with a reference voltage, and mounting detecting means for detecting a mounting of said developer cartridge by said comparator.

11. A process cartridge detachably mountable to a main body of an electrophotographic image forming apparatus, said main body having a supporting portion and cartridge detecting means for detecting that said process cartridge is mounted to said main body, said process cartridge comprising:

an electrophotographic photosensitive drum;

process means acting on said electrophotographic photosensitive drum;

a supported portion to be supported by said supporting portion of said main body when said process cartridge is mounted to said main body; and a detecting action portion provided on said supported portion for operating said cartridge detecting means when said process cartridge is mounted in a mounting position in said main body.

12. A process cartridge according to claim 11, wherein an actuator of said cartridge detecting means is displaced substantially in the same direction as a mounting direction of said process cartridge, whereby said cartridge detecting means is operated.

13. A process cartridge according to claim 11, wherein an actuator of said cartridge detecting means is displaced in a direction intersecting the mounting direction of said process cartridge, whereby said cartridge detecting means is operated.

14. A process cartridge according to claim 11, wherein said process means includes at least one of charging means, developing means and cleaning means.

15. A process cartridge according to any one of claims 11 to 14, wherein an actuator of said cartridge detecting means conducts to a high voltage circuit or a process cartridge presence or absence detecting circuit of said main body of said electrophotographic image forming apparatus or is grounded.

16. A process cartridge according to claim 15, wherein said cartridge detecting means is provided on each of left and right sides as viewed from the mounting direction of said process cartridge, and said cartridge detecting means on one side leads to the high voltage circuit and leads to said process cartridge presence or absence detecting circuit, and said cartridge detecting means on the other side is grounded.

17. A process cartridge detachably mountable to a main body of an electrophotographic image forming apparatus for forming an image on a recording medium, said main body including: (a) a process cartridge mounting portion for detachably mounting said process cartridge; (b) a positioning portion having an electrode provided on said process cartridge mounting portion and to be connected to an electrode of a positioning portion of the cartridge; (c) a high voltage source generating a high-voltage current to be supplied to the electrode connected to the electrode of said positioning portion of the cartridge or a grounding member for grounding the electrode connected to the electrode of said positioning portion of the cartridge; and (d) conveying means for conveying said recording medium, said process cartridge comprising:

an electrophotographic photosensitive member, photosensitive member, process means acting on said electrophotographic photosensitive member; and said positioning portion of the cartridge having the electrode to be connected to the electrode provided on said positioning portion of said process cartridge mounting portion on the main body of said image forming apparatus and for supplying an electric current from the main body of said image forming apparatus to said process means or for grounding said electrophotographic photosensitive member.

18. A process cartridge according to claim 17, wherein said process means includes at least one of charging means, developing means and cleaning means.

19. A process cartridge according to claim 17, wherein one of the process means provided in said process cartridge is charging means for charging the electrophotographic photosensitive member, and the electrodes provided on the positioning portion on the main body of said image forming apparatus and the positioning portion of said process cartridge are electrodes for supplying a high-voltage AC to said charging means, and said image forming apparatus further comprises an AC high-voltage amplifying circuit for supplying a high-voltage AC to said charging means, an AC current detecting circuit for detecting the AC current outputted from said AC high-voltage amplifying circuit, a difference voltage amplifier for amplifying a difference voltage comprising the difference between an output voltage of said AC current detecting circuit and a first reference voltage, a variable amplitude oscillator whose AC-output-voltage waveform amplitude is varied correspondingly to an output voltage of said difference voltage amplifier and is inputted to said AC high-voltage amplifying circuit, a comparator for comparing the output voltage of said AC current detecting circuit with a second reference voltage, and mounting detecting means for detecting the presence or absence of the process cartridge by use of said comparator.

20. A process cartridge according to claim 19, wherein said process means includes at least one of developing means and cleaning means.

21. A process cartridge according to claim 17, wherein one of the process means provided in said process cartridge is developing means for developing a latent image formed on the electrophotographic photosensitive member by use of toner, and the electrodes provided on the positioning portion on the main body of said image forming apparatus and the positioning portion of said process cartridge are electrodes for supplying an AC or rectangular wave high voltage to said developing means, and said image forming apparatus further comprises a high-voltage generating circuit for supplying an AC or rectangular wave high voltage to said developing means, a voltage differential circuit connected to an output from said high-voltage generating circuit, a peak hold circuit connected to an output of said voltage differential circuit, a comparator for comparing an output voltage of said peak hold circuit with a reference voltage, and mounting detecting means for detecting the presence or absence of said process cartridge by said comparator.

22. A process cartridge according to claim 21, wherein said process means includes at least one of charging means and cleaning means.

23. A developer cartridge detachably mountable to a main body of an electrophotographic image forming apparatus for forming an image on a recording medium, said main body including: (a) a developer cartridge mounting portion for detachably mounting said developer cartridge, (b) a positioning portion having an electrode provided on said developer cartridge mounting portion and to be connected to an electrode of a positioning portion of the cartridge; (c) a developing bias power source for supplying a developing bias to the electrode connected to said electrode of the cartridge; and (d) conveying means for conveying said recording medium, said developer cartridge comprising:

a developing roller;

a toner containing portion containing therein a toner to be supplied to said developing roller; and said positioning portion of the cartridge having said electrode to be connected to said electrode provided on said positioning portion of said developer cartridge mounting portion on said main body of said image forming apparatus and for applying the developing bias from the main body of the image forming apparatus to said developing roller.

24. A developer cartridge according to claim 23, wherein said electrophotographic image forming apparatus comprises an electrophotographic photosensitive member, and wherein the developing roller provided in said developer cartridge is developing means for developing a latent image formed on the electrophotographic photosensitive member by use of a toner, and the electrodes provided on the positioning portion on the main body of said image forming apparatus and the positioning portion of said developer cartridge are electrodes for supplying an AC or rectangular wave high voltage to said developing means, and said image forming apparatus further comprising a high-voltage generating circuit for supplying an AC or rectangular wave high voltage to said developing means, a voltage differential circuit connected to an output from said high-voltage generating circuit, a peak hold circuit connected to an output of said voltage differential circuit, a comparator for comparing an output voltage of said peak hold circuit with a reference voltage, and mounting detecting means for detecting the mounting of said developer cartridge by said comparator.

* * * * *

UNITED STATES PATENT AND TRADEMARK OFFICE

CERTIFICATE OF CORRECTION

PATENT NO. : 6,311,026 B1
DATED : October 30, 2001
INVENTOR(S) : Akira Higeta et al.

It is certified that error appears in the above-identified patent and that said Letters Patent is hereby corrected as shown below:

Column 1,
Line 66, "forming," should read -- forming --.

Column 12,
Line 32, "field" should read -- filed --.
Lines 34-35, "In such a construction, as in Embodiment 4, the operator inserts the process cartridge B into the guide positioning" should read -- In the embodiment, means for detecting the mounting of the process cartridge is provided on the positioning --.

Column 22,
Line 23, "afore described" should read -- aforedescribed --.
Line 66, "afore described" should read -- aforedescribed --.

Column 24,
Line 3, "sides" should read -- side --.

Signed and Sealed this

Twenty-first Day of May, 2002

*Attest:*

*Attesting Officer*

JAMES E. ROGAN
*Director of the United States Patent and Trademark Office*